US005993358A

United States Patent [19]

Gureghian et al.

[11] Patent Number: 5,993,358

[45] Date of Patent: Nov. 30, 1999

[54] CONTROLLABLE PLATFORM SUSPENSION SYSTEM FOR TREADMILL DECKS AND THE LIKE AND DEVICES THEREFOR

[75] Inventors: Richard S. Gureghian, Burlington, Mass.; J. David Carlson, Cary, N.C.; Douglas F. LeRoy; Robert H. Marjoram, both of Holly Springs, N.C.; Matthew B. Brown, Raleigh, N.C.; Mark R. Jolly, Holly Springs, N.C.

[73] Assignee: Lord Corporation, Cary, N.C.

[21] Appl. No.: 08/811,668

[22] Filed: Mar. 5, 1997

[51] Int. Cl.[6] ..... A63B 23/00

[52] U.S. Cl. ..... 482/54

[58] Field of Search ..... 482/54; 267/140.14

[56] References Cited

U.S. PATENT DOCUMENTS

| | | | |
|---|---|---|---|
| 3,464,657 | 9/1969 | Bullard . | |
| 3,689,066 | 9/1972 | Hagen . | |
| 4,350,336 | 9/1982 | Hanford . | |
| 4,886,266 | 12/1989 | Trulaske . | |
| 5,277,281 | 1/1994 | Carlson et al. . | |
| 5,284,330 | 2/1994 | Carlson et al. . | |
| 5,336,144 | 8/1994 | Rodden . | |
| 5,382,207 | 1/1995 | Skowronski et al. . | |
| 5,383,828 | 1/1995 | Sands et al. . | |
| 5,398,917 | 3/1995 | Carlson et al. . | |
| 5,441,468 | 8/1995 | Deckers et al. . | |
| 5,454,772 | 10/1995 | Rodden . | |
| 5,476,430 | 12/1995 | Lee et al. | 482/54 |
| 5,492,312 | 2/1996 | Carlson . | |
| 5,542,892 | 8/1996 | Buhler . | |
| 5,547,049 | 8/1996 | Weiss et al. . | |
| 5,749,807 | 5/1998 | Webb | 482/52 |

FOREIGN PATENT DOCUMENTS

| | | |
|---|---|---|
| WO 94/10692 | 5/1994 | WIPO . |
| WO 94/10693 | 5/1994 | WIPO . |
| WO 94/10694 | 5/1994 | WIPO . |

OTHER PUBLICATIONS

Vogt; "Semi–Active Dampers Innovate Shock Control"; *OEM Off–Highway;* Sep. 1995.

"Rheonetic™ Rotary Resistance System"; *Product Specification;* MRB–2107–3; Lord Corp.; 1996.

Carlson, et al.; "Commercial Magneto–Rheological Fluid Devices"; Jul. 10–14, 1995; pp. 1–9.

Design News Article: "Brake Cuts Exercise–Equipment Cost"; Dec. 4, 1995.

Vogt; "Creating a Smoother Ride"; *Equipment Today;* Sep. 1995.

"Rheonetic Magnetic Fluid systems"; Lord Corporation brochure; Mar. 1996.

*Primary Examiner*—Glenn E. Richman
*Attorney, Agent, or Firm*—Randall S. Wayland

[57] ABSTRACT

A controllable platform suspension system (20) for treadmills (18) and other platforms and devices therefor which exhibit controllability of the impact condition of the platform, such as a treadmill deck (36). In the treadmill application, user-selectable damping/stiffness is provided to simulate variable track conditions, such as pavement, rubber, grass, gravel, sand, and the like. The controllable suspension system (20) comprises spring mounts (40) or the like or a flexible deck (36) for allowing movement of the deck (36) relative to the frame (22) at a contact location (29) due to impact and a controllable device such as an Electrorheological (ER) device, Electrophoretic (EP) device, Electromechanical Hydraulic (Semi-Active) device, controllable mounting, or a Magnetorheological (MR) device, such as an MR brake (42*a*, 42*a*, 42*b*), MR damper (42*d*), or MR mount (42*c*, 42*e*, 42*f*) interconnecting between the frame (22) and platform (36) to provide the user-variable impact restraint. Various MR devices are described which exhibit controllability in a first direction (ex. bound) and substantially unrestricted motion in a second direction (ex. rebound).

37 Claims, 11 Drawing Sheets

37d
Fd
29d
20d
42d
42d'
40d
36d
40d'
40d"
40d'''
28d'
27d
28d"

36d
50d
69d
54d
Bound
Rebound
53d
51d
58d
56d
78d
62d
82d
81d
80d
28d'
44d
53d'
73d
52d
42d
91d
60d
83d
27d
90d
79d
FL"
78d'
86d
84d
88d
55d
70d
70d'

82d
90d
78d
58d
81d
78d'
86d 83d
90d
86d

CONTROLLABLE PLATFORM SUSPENSION SYSTEM FOR TREADMILL DECKS AND THE LIKE AND DEVICES THEREFOR

FIELD OF THE INVENTION

This invention relates generally to the area of controllable devices and systems. Specifically, it relates to controllable devices and apparatus which preferably employ controllable fluids which exhibit controllable damping/stiffness characteristics.

BACKGROUND OF THE INVENTION

Dampers, shock absorbers, brakes and clutches are known which use a fluid as the working medium to create damping forces/torques to control motion, shock, and/or vibration. One class of these devices are controllable and the devices employ Electrorheological controllable fluids (ER), Electrophoretic fluids (EP), Magnetorheological fluids (MR), and Hydraulic fluids (Semi-Active Electro-mechanical), etc. Of particular interest are Magnetorheological (MR) fluid devices. MR fluid devices may be of the rotary or linear-acting variety, such as MR dampers, MR brakes and MR clutches. They employ an MR fluid comprised of small soft-magnetic particles disbursed within a liquid carrier. Typical particles include carbonyl iron having various shapes, but which are preferably approximately spherical, and which exhibit mean dimensions of about between about 0.1 to 500 $\mu$m, and more preferably between 1 and 100 $\mu$m. The carrier fluids include various known hydraulic oils, silicone oils, and the like. These MR fluids exhibit a "thickening" behavior (a rheology change), sometimes referred to as an "apparent viscosity change", upon being exposed to a magnetic field of sufficient strength. The higher the magnetic field strength to which the MR fluid is exposed, the higher the damping force that can be achieved in the particular MR device. Examples of prior art fluids can be found in WO 94/10694, WO 94/10693, and WO 94/10692 the inventions of which are commonly assigned to the assignee of the present invention. Notably, MR fluid devices provide ease of controllability through simple variations in electrical current supplied to the devices and the fluids and devices have demonstrated durability yet unobtained with ER devices (ER fluids exhibit a rheology change upon being exposed to an electric field) and simplicity previously unachievable with controllable semi-active hydraulic devices (which include electromechanical valves).

Descriptions of prior art MR fluid devices can be found in U.S. application Ser. No. 08/304,005 entitled "Magnetorheological Fluid Devices and Process of Controlling Force in Exercise Equipment Utilizing Same", U.S. Ser. No. 08/613,704 entitled "Portable Controllable Fluid Rehabilitation Devices", U.S. Ser. No. 08/610,796 entitled "Controllable Fluid Rehabilitation Device Utilizing a Reservoir of Fluid", U.S. Ser. No. 08/674,371 entitled "Controllable Brake", U.S. Ser. No. 08/674,179 entitled "Controllable Vibration Apparatus" and U.S. Pat. Nos. 5,547,049, 5,492,312, 5,398,917, 5,284,330, and 5,277,281, all of which are commonly assigned to the assignee of the present invention. Notably, these devices provide user-variable/selectable control forces or torques, as the case may be.

Exercise treadmills comprise a deck, a frame, a continuous treadmill belt rotatably entrained and supported about rollers. The rollers are suspended from the frame and a motor and transmission preferably drive the rollers and/or the treadmill belt (the powered type). Generally, the user may control the speed of the treadmill belt to correspond with walking, running, jogging, etc. Notably some treadmills are rotatably engaged by the exertion of the user (the unpowered type). Prior art treadmills have incorporated a passively and flexibly supported deck or various other "passive" means for cushioning the impact of the user with the deck. Certain of these passive deck support systems can be found in U.S. Pat. Nos. 3,689,066, 5,542,892, 4,350,336, 5,382,207, 5,441,468, and 5454,772. Notably, these devices lack any controllability.

SUMMARY OF THE INVENTION

The present invention is a controllable suspension system for a platform, which is particularly useful in a treadmill exercise apparatus for producing a variable "feel" characteristic of the treadmill deck contacted by the treadmill user. This deck "feel" can be adjusted by the user or through an appropriate computer program, manual selection, or the like to change the bound (vertical downward) rate (impact spring rate or damping rate) of the deck of the treadmill as the user impacts the deck with his/her foot. In this way, the user can adjust the "feel" of the deck to simulate various running surfaces, for example running on pavement, rubber track, gravel, grass, sand, etc. or more generally, to provide a deck which has various and selectable response to impact forces exerted thereon. In a broader sense, the damping and/or stiffness of the MR devices supporting the deck platform can be adjusted, thereby proving the means for controlling impact conditions of whatever is coming into contact with the deck platform. The means for providing control of impact conditions comprises an controllable electromechanical device. In another aspect, devices and means are described herein whereby controllable forces can be achieved in one direction and uncontrollable, and relatively free return (rebound), may be provided in the other direction without having to "rapidly switch" between a high and low damping state as in prior art MR devices.

It is an advantage of one aspect of the present invention controllable suspension system that variable forces restraining impact can be obtained, thereby providing a variable impact "feel" continuously ranging from a "soft" condition to "hard" condition.

It is an advantage of the controllable platform suspension system of the present invention that the impact force condition produced can be easily and quickly adjusted by the user, i.e., it is "user selectable" or it may be controlled by a digital controller, computer, or microprocessor to follow a preselected regimen.

It is an advantage of the controllable deck platform suspension system of the present invention when applied to a treadmill deck that the forces produced can be adjusted by the user to simulate various running surfaces such as pavement, a rubber track surface, grass, gravel, sand, or the like.

It is an advantage of the controllable deck platform suspension system of the present invention when applied to a treadmill that the impact forces produced can be adjusted to reduce the stress exerted upon the user's legs when exercising, thereby providing "low impact" physical exercise.

It is an advantage of the controllable suspension system of the present invention, and the MR devices contained therein, that the forces produced in a first direction (ex. bound) and a second direction (ex. rebound) can be different.

It is an advantage of the controllable suspension system of the present invention and devices therein that the damping forces produced in the second direction (ex. rebound) can be minimized thereby minimizing or eliminating the need to "rapidly switch" a controllable MR device from a "high" state to a "low" state.

It is an advantage of the controllable suspension system of the present invention, and the MR devices contained therein, that the forces produced may be shaped as a function of time through appropriate feedback mechanisms.

The abovementioned and further features, advantages, and characteristics of the present invention will become apparent from the accompanying descriptions of the preferred embodiments and attached drawings.

BRIEF DESCRIPTION OF THE DRAWINGS

The accompanying drawings which form a part of the specification, illustrate several key embodiments of the present invention. The drawings and description together, serve to fully explain the invention. In the drawings.

DETAILED DESCRIPTION OF THE PREFERRED EMBODIMENTS

Figure 1:
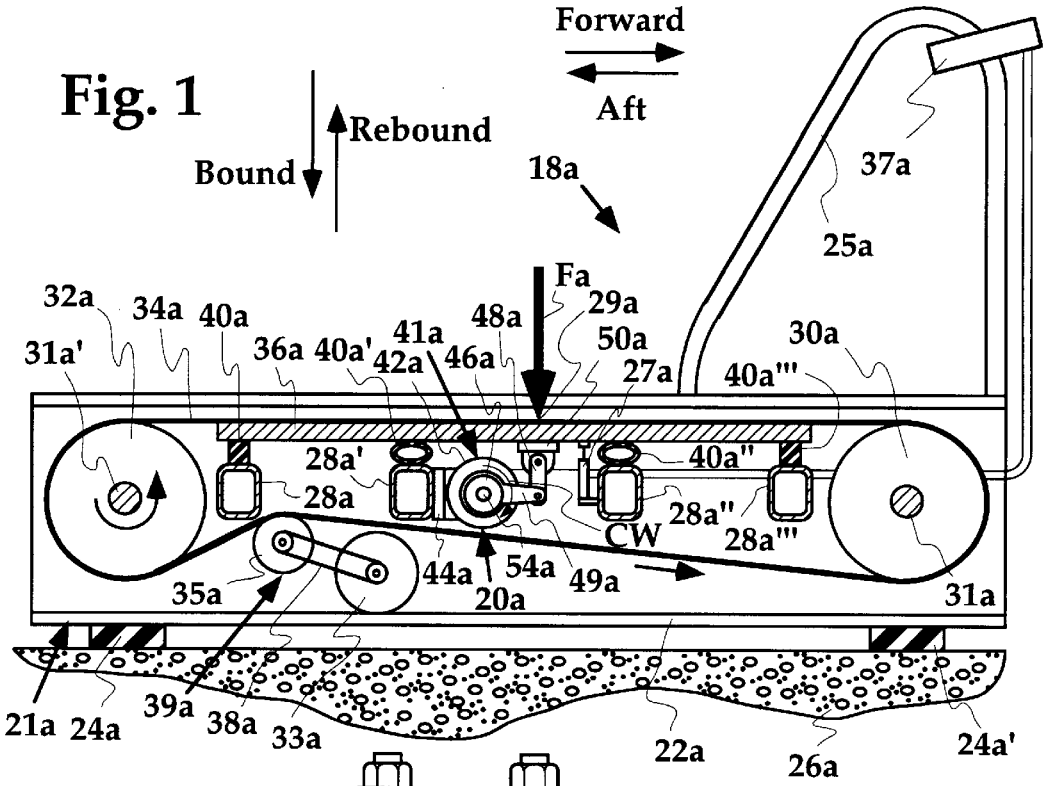
FIG. 1 illustrates a partial cross-sectioned side view of a controllable deck platform suspension system of the present invention utilized on a treadmill and including a rotary MR brake and one-way clutch.

Referring now to the Drawings where like numerals denote like elements, in FIG. 1, shown generally at 20*a*, is a first embodiment of a controllable platform suspension system 20*a* included within a treadmill device 18*a*. The treadmill 18*a* is a generally useful device for cardiovascular exercise of the user in a walking, running, or jogging mode. The controllable platform suspension system 20*a* described herein preferably exhibits user-controllable (user-variable or user-selectable) restraining force characteristics for simulating various impact responses. For example, various hardness or types of running surfaces may be simulated (it provides a user-variable deck "feel"). In other words, the deck 36*a* deflects under the control of a controllable device, such as a controllable linear damper, rotary damper/brake, or controllable mount. Notably, the controllable devices may be, for example, controllable Electrorheological (ER), controllable Electrophoretic (EP) or controllable Electro-mechanical (Semi-active), however, most preferably, they are controllable Magnetorheological (MR) devices.

Generally, the treadmill 18*a* includes a treadmill frame 21*a* having several frame side rails 22*a* (only the left side frame is shown), rigid cross support bars 28*a*, 28*a*', 28*a*", 28'" which interconnect the frame rails 22*a* (one shown), hand rails 25*a* for the user to grasp, front and back roller wheels 30*a*, 32*a* which include shafts 31*a*, 31*a*' and which are rotatably supported by bearings (not shown) which rigidly, yet rotatably attach the shafts 31*a*, 31*a*' to the frame rails 22*a*, a continuous-roll tread 34*a* which is supported by, and entrained about, the wheels 30*a*, 32*a*, and a treadmill deck 36*a* which supports the portion of the tread 34*a* upon which the user runs, jogs, walks, etc. Notably, the user contacts the tread 34*a* and deck 36*a* substantially adjacent to the contact location 29*a* which is generally located near the middle or forward center of the deck 36*a*. A drive assembly 39*a* preferably rotatably drives the tread 34*a*. Preferably, the drive assembly 39*a* includes the motor 33*a*, drive wheel 35*a*, and transmission means 38*a* (belt and pulleys) shown. Alternatively, the drive system may drive one or more of the wheels 31*a*, 31*a*', etc. A controllable suspension system 20*a* flexibly suspends the deck 36*a* relative to a frame 21*a* and allows adjustability of force/damping restraint characteristics of the deck 36*a*. In particular, an impact or bound condition (responsive to the generally vertical-downward motion initiated by the impact of the user's foot) is adjustable as to the magnitude and/or other characteristics thereof. An electronic controller 37*a* enables the user to command an adjustment in force/damping restraint to accomplish the user-adjustable deck impact characteristics or "feel." This control may take the form of a manually adjustable current, a program defined current, a shaped current which is shaped as a function of deflection or some other parameter, and may include closed-loop feedback control.

The frame 21*a* may include feet 24*a*, 24*a*' for supporting the treadmill 18*a* relative to a floor structure 26*a*. The deck 36*a* which is preferably rectangularly-shaped and manufactured from a low friction and preferably flexible material. Suitable materials include plastic, rubber, and flexible matrix composites (which exhibit low bending stiffness and high torsional stiffness accomplished by the appropriate angle of orientation of the fibers and a compliant matrix material). Alternatively, the deck 36*a* may be rigid. The deck 36*a* is preferably resiliently supported relative to the frame 21*a* and crossbars 28*a*, 28*a*', 28*a*", 28'". The resilient support acts as the means for allowing generally vertical motion of the treadmill deck 36*a* at the contact location 29*a* relative to the treadmill frame 21*a*. The means for allowing generally vertical movement may include elastomer mounts, fluid mounts, ring mounts, the deck itself being flexible, spring mounts, or combinations thereof.

Generally, the means for varying the resistance/damping restraint force, and preferably, the vertical "bound" force, will comprise a controllable assembly 41*a* which includes a variable damping or stiffness means, such as the MR rotary brake 42*a*. The brake 42*a* is attached in parallel spring relationship to the means for allowing generally vertical motion. Other preferable means for providing variable damping or stiffness comprise MR mounts and MR linear dampers, which will be described in detail later herein. The means for allowing vertical motion in this embodiment comprises elastomer mounts 40*a*, 40*a*'" located at the ends of deck 36a, ring mounts 40*a*', 40*a*" adjacent to the center forward portion, and a flexible deck 36*a*, which in combination function to flexibly suspend the deck 36*a* relative to the frame crossbars 28*a* and provide for vertical motion accommodation and some shock/impact absorption. Preferably, the mounts 40*a*, 40*a*'" will be as soft as practicable in shear (forward and aft directions) and include minimal damping. Mounts 40', 40" are preferably located adjacent to the contact location 29*a* and should be soft as practicable, such that a maximum force variability can be achieved by the controllable assembly 41*a*. Elastomer mounts are particularly effective at supporting high vertical loads yet remaining flexible in shear to accommodate forward and aft motion at the mounts 40*a*, 40*a*'" due to flexing of the deck 36*a* as the user exercises.

The MR device 42*a* shown is a rotary-acting MR brake which is mounted relative to the frame 21*a*, and in particular, stationarily mounted relative to crossbar 28*a*', via mounting bracket 44*a*. The rotatable shaft 54*a* of the MR device 42*a* is preferably attached, in an in-line fashion, to an optional one-way clutch mechanism 46*a*. The optional one-way clutch 46*a* allows rotary engagement in a first rotational direction (clockwise as indicated by the arrow CW) while allowing substantially free rotation without engagement in a second rotational direction (the counterclockwise direction). The one-way clutch 46*a* includes a lever arm 49*a* rigidly secured thereto which is interconnected to the deck 36*a* via appropriate means, such as a linkage 48*a* and deck bracket 50*a*. Together, the lever arm 49*a*, linkage 48*a*, and bracket 50*a* comprise the means for converting generally vertical motion into rotary motion and the means interconnecting the brake 42*a* with the deck 36*a*.

In operation, generally vertical movement of the deck 36*a* produced by the user exerting an impact force adjacent to the contact location 29*a* due to running, jogging, walking, etc., on the point of the deck 36*a* indicated by arrow Fa, causes compression of mounts 40*a*, 40*a*', 40*a*", 40'" (and may cause shear of fore and aft mounts 40*a*, 40*a*'" in the forward and aft directions). This causes linkage 48*a* to move downward and arm 49*a* to rotate clockwise, as indicated by arrow CW, on the bound (generally vertically downward) stroke. This causes the one-way clutch 46*a* to engage, thereby causing one-way rotation of the shaft 54*a* of the rotary MR device 42*a*. Applying sufficient electrical current to the coil 62*a* (FIG. 2) of the MR device 42*a* causes a change in rheology (an apparent viscosity change) of the MR fluid 60*a* (FIG. 2) contained therein. This causes a resistance change between the internal components (to be fully described later) which thereby resists further rotation of the shaft 54*a*. Resultantly, by allowing means for varying the current supplied to the MR brake 42*a* by the user, a variable and preferably user-selectable restraining force is produced between the treadmill frame 21*a* and the treadmill deck 36*a*.

This resistance force can be varied by the user according to a user selection criteria embodied in the controller 37*a*. This may include a simple dial mechanism for adjusting the current or, alternatively, a digital selection. For example, the user may select a "firm" setting (correlated to high or maximum current applied to the MR brake device 42*a*) or a "soft" setting (correlated with some minimal current level or zero current applied) or any number of intermediate settings. A "firm" setting minimizes displacement of the deck 36*a* as contacts occurs and simulates running on a firm surface, such as pavement, concrete, wood or the like. Conversely, a "soft" setting will simulate a soft surface, such as a sand surface or the like. Intermediate levels may simulate rubber track conditions or the like. It should be appreciated that controlling the deck "feel" may be advantageous for limiting the impact forces exposed to the user's legs and body.

Likewise, the current may be set to a constant DC level and have an AC oscillation (pulsing effect) superimposed thereon, i.e., a dither, to simulate running on a gravel surface, a stone surface, or the like. The frequency, pulse width, and/or amplitude of the dither may be adjustable as well, such that one to several cycles may be experienced during the bound stroke. Moreover, the shape of the AC dither current waveform may be varied in order to change the deck "feel" during impact. The waveform shape may be, for example, sinusoidal, triangular, square wave, or the like.

In another novel aspect, it should be appreciated, that when operating this embodiment with a constant DC amplitude applied to the device 42*a*, one deck "feel" will be provided for the user in the "bound" direction, yet, the deck 36*a* will spring back to its original position rapidly because of the lack of damping/resistance in the "rebound" direction. The rapid rebound response is due to the one-way clutch 46*a*. This rapid response quickly positions the deck 36*a* for the next impact force exerted. Use of the one-way clutch 46*a* has the advantage of eliminating the need to "rapidly" switch the MR device to accomplish different damping force characteristics in bound and rebound.

Notably, if the appropriate control and sensors are available, the one-way clutch 46*a* could be eliminated and the current to the MR brake 42*a* could be "rapidly" switched, in real-time, from a "high" level to a "low" level. A sensor 27*a*, such as a displacement, velocity, force, or acceleration sensor, or combinations thereof would be provided to synchronize the user's contact with the appropriate force commanded. For example, the position sensor could provide location and direction information. In this fashion, the different response rates could be provided in the "bound" and "rebound" directions. Further, various force profiles which vary as a function of displacement could be implemented by setting the current as a function of displacement dependent upon predetermined values of current stored in a lookup table.

In an even simpler embodiment, the one-way clutch 46*a* may be eliminated altogether and no rapid switching (controller and sensors) may be required, provided the damping level is low enough to obtain the appropriate springing back of the deck 36*a* on the "rebound" stroke. In this simplest embodiment, a variable and user-adjustable direct current would be supplied to the MR brake 42*a* and the arm 49*a* would connect directly to the shaft 54*a* of the MR brake 42*a*.

Figure 2:
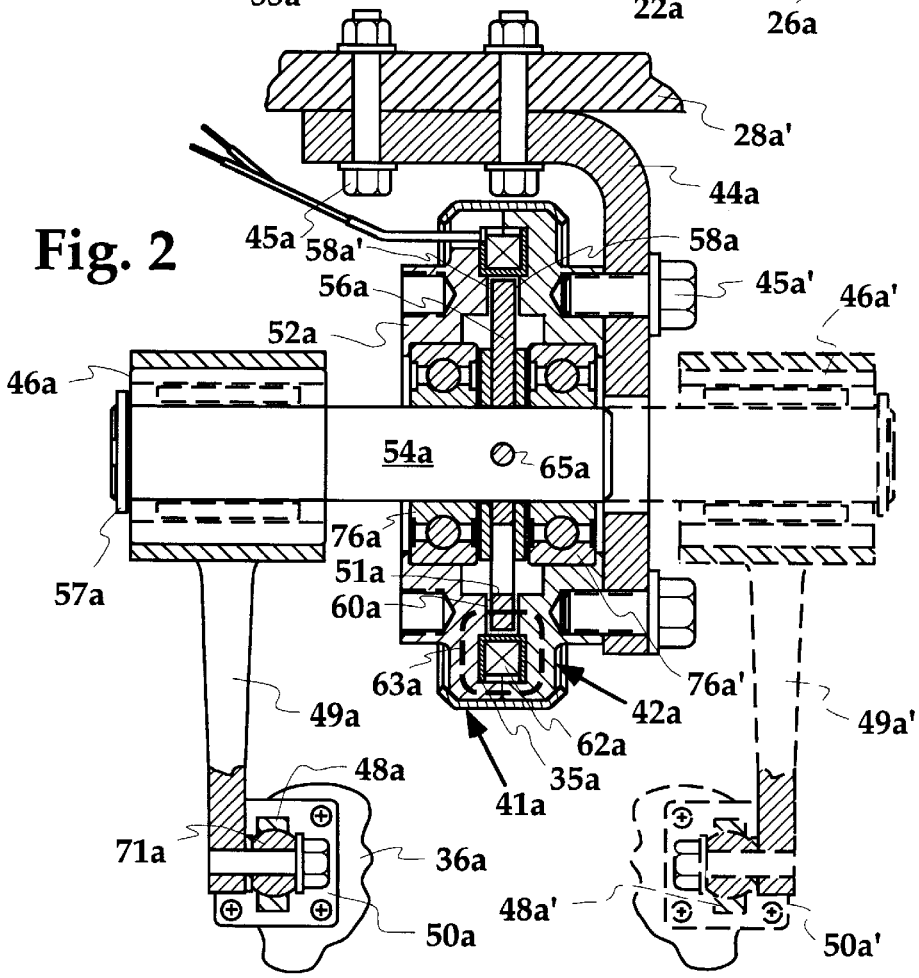
FIG. 2 illustrates a partial cross-sectioned bottom view of the rotationally controllable assembly of FIG. 1 within the controllable deck suspension system.

FIG. 2 illustrates a bottom and partially-cross-sectioned view of the controllable assembly 41*a* which is comprised of an MR brake 42*a*, mounting bracket 44*a*, one-way clutch 46*a*, arm 49*a*, linkage 48*a*, and deck bracket 50*a*. Optionally, the assembly may include an additional one-way clutch 46*a*', arm 49*a*', linkage 48*a*', and deck bracket 50*a*'. The MR brake 42*a* is comprised of a housing 52*a* manufactured from a soft-magnetic material, such as steel or the like, and which includes a magnetic circuit therein for appropriately directing the magnetic field across a working portion of the rotor 56*a*. The housing 52*a*, which is comprise of two piece construction, includes a recess 51*a* formed therein which receives a portion of a soft magnetic disc-like rotor 56*a* to form at least one gap, and in this case, two radially-extending gaps 58*a*, 58*a*'. A magnetorheological fluid 60*a* containing soft-magnetic particles (preferably carbonyl iron having a mean size between about 1 $\mu$m to 500 $\mu$m and 20%–40% by volume particle loading) and a preferably nonviscous carrier oil is contained with the gaps 58*a*, 58*a*'. The fluid 60*a* exhibits a rheology change upon being exposed to the magnetic field. A hoop wound coil 62*a* supported by a bobbin 35*a* and housing 52*a* functions as the magnetic field generator and produces the magnetic field which acts upon the fluid 60*a* contained in the gaps 58*a*, 58*a*' as illustrated by an approximate flux line 63*a* contained in the magnetic circuit.

The shaft 54*a* is interconnected to the rotor 56*a* and restrained from rotation therefrom by suitable means, such as pin 65*a* which meshes with slot in rotor 56*a* (not shown). Preferably, sealed bearings 76*a*, 76*a*' support the shaft 54*a* axially and radially and allow rotation relative to the housing 52*a*. Mounting bracket 44*a* is secured to housing 52*a* and cross support 28*a*' by fasteners 45*a*, 45*a*' thereby preventing rotation of the housing 52*a* relative to cross member 28*a*'.

The one-way clutch 46*a* attaches to shaft 54*a* and is preferably restrained axially by optional retaining ring 57*a*. Rigid arm 49*a* attaches to one-way clutch 46*a* by welding, pressing, locking adhesive, or the like and also attaches to linkage 48*a*. Linkage 48*a* preferably includes means for allowing rotation and misalignment, such as ball joints 71*a*. Likewise, pin joints or other motion/rotation accommodating means could be used. The linkage 48*a* interconnects between the deck bracket 50*a* and the end of arm 49*a*. Deck bracket 50*a* attaches by screws, or the like, underneath deck 36*a*. A further description of the MR Rotary brake 42*a* may be obtained in commonly-assigned U.S. Ser. No. 08/304,005 to Carlson et al. entitled "Magnetorheological Fluid Devices And Process Of Controlling Force In Exercise Equipment Utilizing Same."

Figure 3:
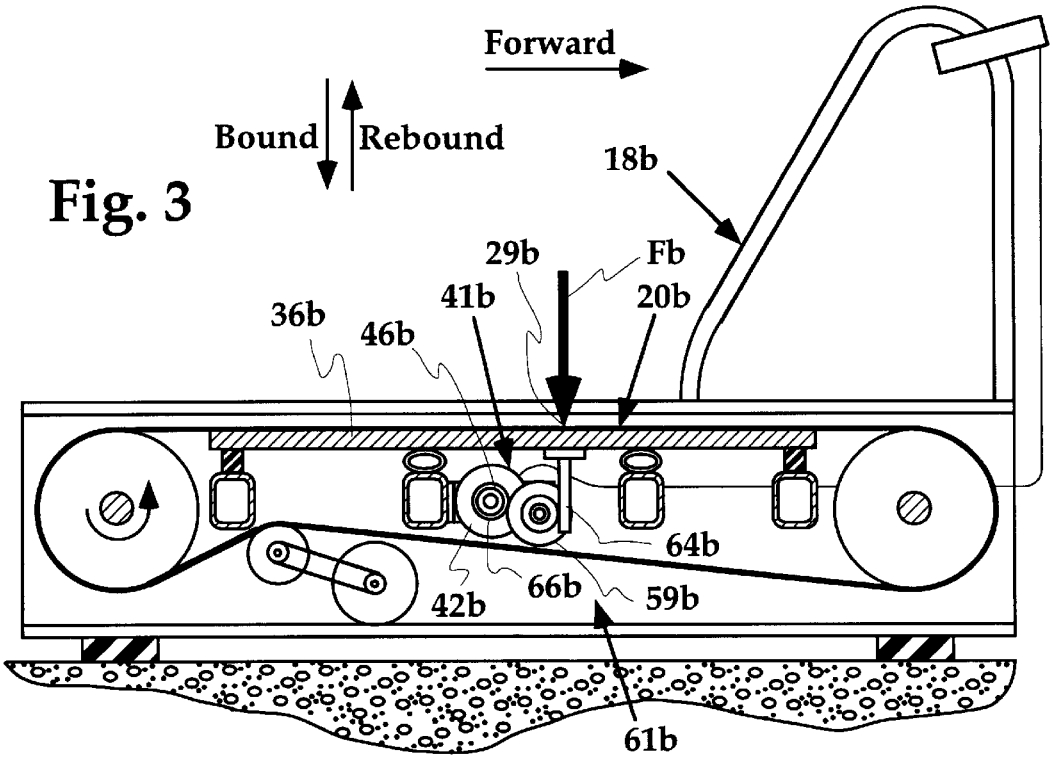
FIG. 3 illustrates a partial cross-sectioned side view of a controllable deck platform suspension system of the present invention within a treadmill with a rotary MR brake and a rack-and-pinion assembly.
Figure 4:
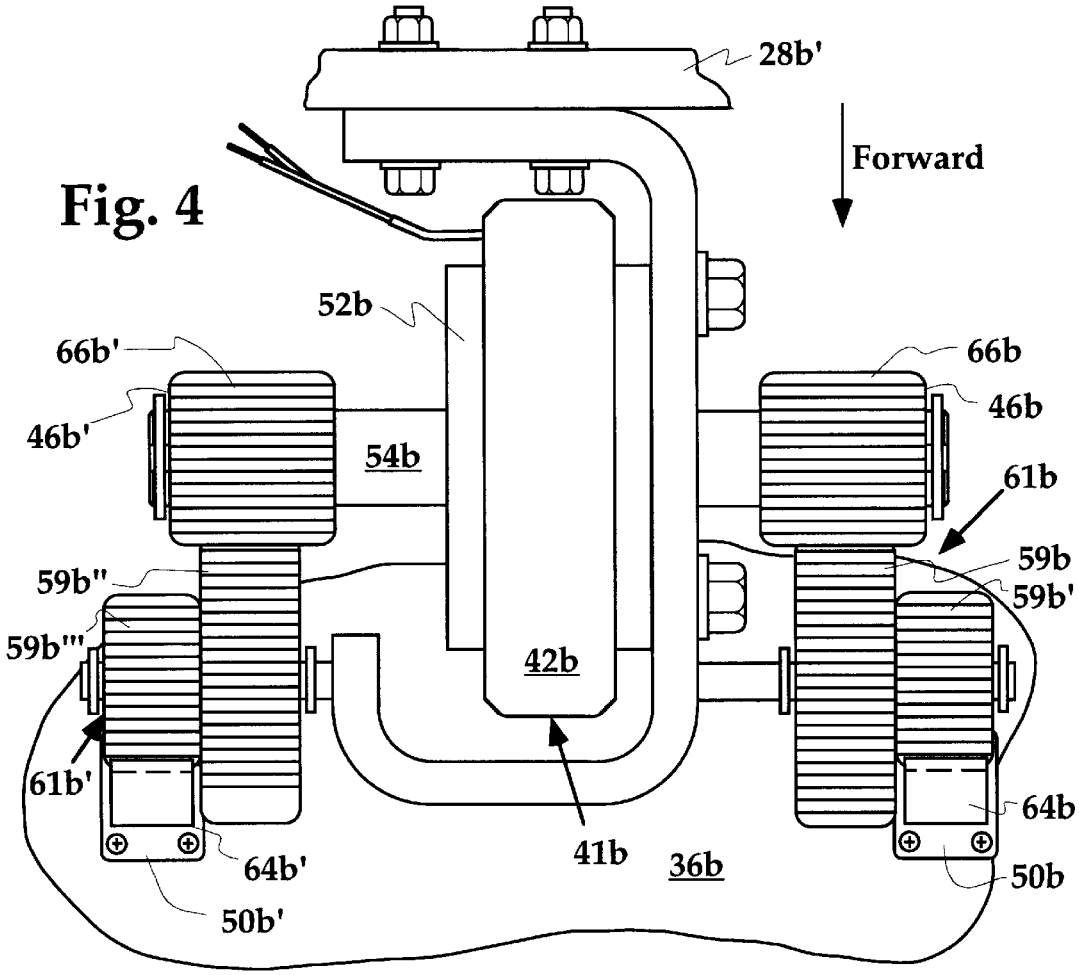
FIG. 4 illustrates a partial bottom view of the controllable assembly of FIG. 3 within the controllable suspension system.

FIG. 3 and 4 illustrate another embodiment of controllable suspension system 20*b* for a platform, such as a deck 36*b* on a treadmill 18*b*. The difference between this embodiment and the previous embodiment of FIG. 1 and 2 is the use of one or more rack-and-pinion assemblies 61*b*, 61*b*' instead of the arm-and-link assembly used in the previous embodiment as the means for interconnecting the deck 36*b* to the brake 42*b* in the controllable assembly 41*b*. In this novel embodiment, attached (press fit, glued, etc.) to the outside periphery of one-way clutches 46*b*, 46*b*' are pinion gears 66*b*, 66*b*' which include a plurality of gear teeth formed thereon. Racks 64*b*, 64*b*' interconnect between the optional freewheel gears 59*b*, 59*b*', 59*b*", 59*b*'" (some of which mesh with pinion gears 66*b*, 66*b*') and deck brackets 50*b*, 50*b*'. Racks 64*b*, 64*b*' are rigidly connected to brackets 50*b*, 50*b*'. The racks 64*b*, 64*b*', freewheel gears 59*b*, 59*b*', 59*b*", 59*b*'", pinion gears 66*b*, 66*b*', and deck brackets 50*b*, 50*b*', make up the rack-and-pinion assembly 61*b*, 61*b*'. The rack-and-pinion assemblies 61*b*, 61*b*' interconnect between the deck 36*b* and the one-way clutches 46*b*, 46*b*' and provide the means by which generally vertical motion of the deck 36*b* due to impact force Fb adjacent to the contact location 29*b* is converted into rotary motion of the one-way clutch 46*b*, 46*b*' and, thus, rotary motion of the MR brake 42*b*.

The pinion gears 66*b*, 66*b*', freewheel gears 59*b*, 59*b*', 59*b*", 59*b*'" and racks 64*b*, 64*b*' include mating teeth which mesh and engage appropriately upon generally vertical movement of deck 36*a*. The diameter of pinion gears 66*b*, 66*b*' and freewheel gears 59*b*, 59*b*', 59*b*", 59*b*'" may be selected to appropriately gear the rotation of brake 42*b*. For example making gears 59*b*'", 59*b*' smaller and rigidly connected gears 59*b*, 59*b*" larger will gear up the rotation making the shaft 54*b* rotate faster. The one-way clutches 46*b*, 46*b*' are preferably a one-directional drive mechanism, for example, a roller-type clutch manufactured by Berg, or the like. The rotary brake 42*b* shown herein is available from Lord Corporation of Cary, N.C. as part number MRB-2107. In an alternate embodiment, the shaft 54*b* may be stationarily secured relative to frame 28*b*' by appropriate means and the housing 52*b* may be rotatable. The rack 64*b* may then contact gear teeth formed on an outer periphery of the brake 42*b*. A slip ring or the like would be required to get electrical current into the brake 42*b*.

Figure 5:
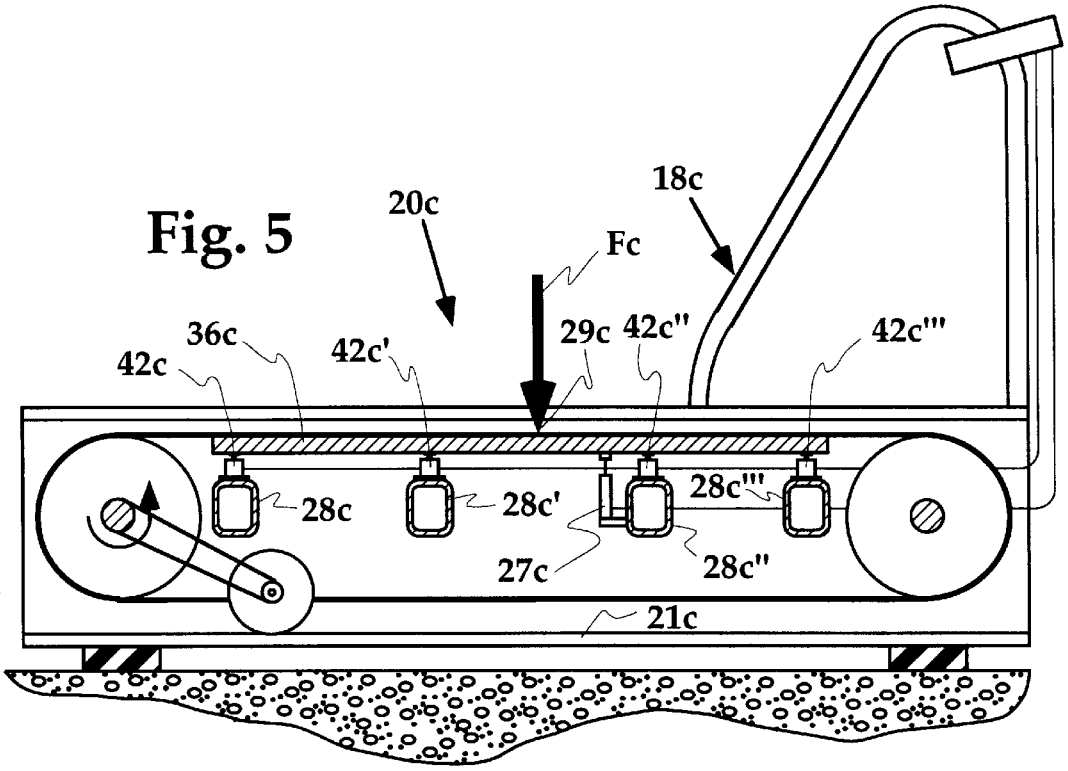
FIG. 5 illustrates a partial cross-sectioned side view of another controllable deck platform suspension system of the present invention on a treadmill with a plurality of MR mounts supporting the deck.
Figure 6:
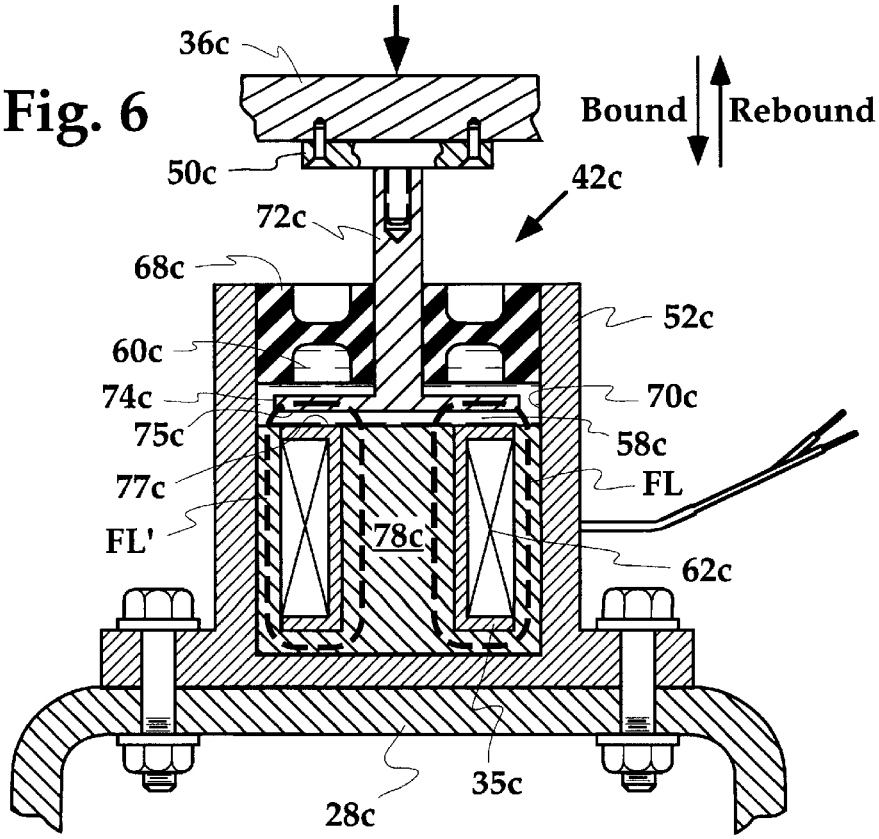
FIG. 6 illustrates a partial cross-sectional side view of a controllable assembly of FIG. 5 within the controllable suspension system.

FIG. 5 and FIG. 6 illustrate another embodiment of controllable deck suspension 20*c* on a treadmill 18*c*. In this embodiment, the controllable means for controlling the "bound" or impact condition of the treadmill deck 36*c* is a magnetorheological fluid device, such as the magnetorheological fluid mounting 42*c* shown, and preferably, a plurality of mountings 42*c*, 42*c*', 42*c*" , 42*c*'". The mountings 42*c*, 42*c*', 42*c*", 42*c*'" each preferably include a generally cylindrical housing 52*c* which attaches to the crossbars 28*c*, 28*c*', 28*c*", 28*c*'", an inner member 72*c* which interconnects to the deck 36*c* (via deck brackets 50*c* and fastening means) and at least one flexible member 68*c*, such as the elastomer section shown, which is attached between the housing 52*c* and inner member 72*c*. Preferably, the at least one flexible member 68*c* is bonded by known processes to inner member 72*c* and housing 52*c*. The flexible member 68*c* may provide the integral vertical support of the deck 36*c*, as well as the means for flexibly suspending the deck 36*c*. A fluid chamber 70*c*, which is at least partially defined by the at least one flexible member 68*c* and housing 52*c*, contains a magnetorheological fluid 60*c*.

The controllable means for restricting flow of the magnetorheological fluid 60*c* restricts flow "within" the first fluid chamber 70*c* itself. The damping mode provided in this mount 42*c* is referred to as a squeeze film mode, in that the fluid is squeezed out laterally upon generally vertical movement of the inner member 72*c* relative to the housing 52*c*. Notably, the mount 42*c* may effectively damp rotational and pivotal motions as well. A disc member 74*c* is attached to the inner member 72*c* and includes a first reaction surface 75*c* formed thereon. A second reaction surface 77*c* is generally opposed to the first reaction surface 75*c*. Between the surfaces 75*c*, 77*c* is at least one working gap 58*c* which contains magnetorheological fluid 60*c*. Electrically energizing the coil 62*c* which is circumferentially hoop wound about bobbin 35*c* causes a magnetic field (representative flux lines illustrated by lines FL, FL') to be produced. This field is directed toward the working gap 58*c* by soft magnetic pole piece 78*c* and soft magnetic disc member 74*c* (which provides the return path for the magnetic flux). Together, the coil 62*c*, pole piece 78*c*, fluid 60*c* and disc 74*c* comprise the magnetic circuit. The coil 62*c* provides the means for producing the magnetic field. The magnetic field within the magnetic circuit causes the MR fluid 60*c* in the gap 58*c* to change rheology (exhibit an apparent change in viscosity). This causes an apparent solidification of the fluid 60*c* within the gap 58*c* and restrains flow of the fluid 60*c* out of the gap 58*c*. This restrains vertical motion (bound and/or rebound) of the inner member 72*c* relative to the housing 52*c* as well as rotation and pivotal motion. Therefore, when a current is commanded to mount 52*c*, a restraining force is developed to resist vertical motion of the deck 36*c* due to the user's impact force Fc applied adjacent the contact location 29*c*.

The MR mounting 42*c* may be switched at the appropriate frequency and phase to provide variable damping (restraining forces) in the bound stroke (current on) and minimal damping (current off) in the rebound stroke. Likewise, pulsed dither may be applied or any of the other control strategies as before-mentioned.

A sensor 27*c*, such as a rotary-type or linear-type position sensor or velocity sensor located between the frame 21*c* and deck 36*c* may be required for the differential bound/rebound control of the mountings 42*c*, 42*c*', 42*c*", 42*c*'" depending upon the type of control used. Sensor 27*c* may provide displacement, velocity, or both as well as a direction indication. Some or all of this information may be used by the control system to "rapidly" switch, in real-time, the electrical current to apply controlled damping in the bound stroke and minimize damping in the rebound stroke. A simple control would be comprised of commanding a user selected DC current to the mounts 42*c*, 42*c*', 42*c*", 42*c*'" when a bound condition is sensed and a minimum current (usually zero) when rebound is sensed. Sensor 27*c* may be eliminated if differential fast switching in the bound and rebound directions are not required. For example, when simple user-variable direct current is used, fast switching is not required, provided the appropriate spring back of deck 36*c* is obtainable. Further descriptions of squeeze film type mountings may be found in commonly assigned U.S. Pat. No. 5,492,312 to Carlson entitled "Multi-Degree of Freedom Magnetorheological Device and System for Using Same." Other MR mounts which may be used in the controllable platform suspension are described in U.S. Pat. No. 5,398,917 to Carlson et al. entitled "Magnetorheological Fluid Devices." Likewise, the mountings may include passive means for obtaining the differential damping in the bound and rebound direction, as will be described with reference to the FIG. 8*a* embodiment.

FIG. 7 and FIGS. 8*a*, 8*b*, and 8*c* illustrate another embodiment of controllable suspension 20*d* for a treadmill or the like, and describes the components thereof in detail. In this embodiment, the controllable means for controlling the "bound" or impact condition of the treadmill deck 36*d* comprises at least one magnetorheological fluid device, such as a magnetorheological fluid linear-acting damper 42*d*. Preferably, the means for controlling the impact condition preferably comprises a plurality of dampers, such as 42*d*, 42*d*' shown spaced apart and adjacent to the contact location 29*d*. Only two of the dampers are shown. Preferably, two are located on either side of the deck 36*d* near the lateral edges thereof, for a total of four. However, as many as eight dampers may be strategically located to control the feel of deck 36*d*. Preferably, the dampers will be electrically wired together (in parallel) such that they act in unison and are provided the same control commands.

The dampers 42*d*, 42*d*' attach by way of brackets 50*d*, 44*d* between the deck 36*d* and the crossbars 28*d*', 28*d*". Spring means, such as mounts 40*d*', 40*d*'" and/or optional ring mounts 40*d*', 40*d*", or the like, are installed in parallel relationship to dampers 42*d*, 42*d*'. Preferably, at least three springs are needed. The dampers 42*d*, 42*d*' are user adjustable to vary the "feel" of the deck 36*d*, i.e., the damping level may be adjusted from a "full-on" condition to "full-off" condition or at various levels in between depending upon the electrical current supplied to the dampers 42*d*, 42*d*'. The current may be appropriately adjusted by the user via adjustment mechanisms (switches, buttons, computer programs, or other selectable means) on the controller 37*d* to resist the impact force Fd generated by the user's foot impacting the deck 36*d*. Sensor 27*d* may be used to provide information on position, velocity, and/or direction to accomplish various force profiles and/or "rapid", real-time, switching between a "high" damping state in the "bound" direction and "low" damping state in the "rebound" direction.

Figure 8A:
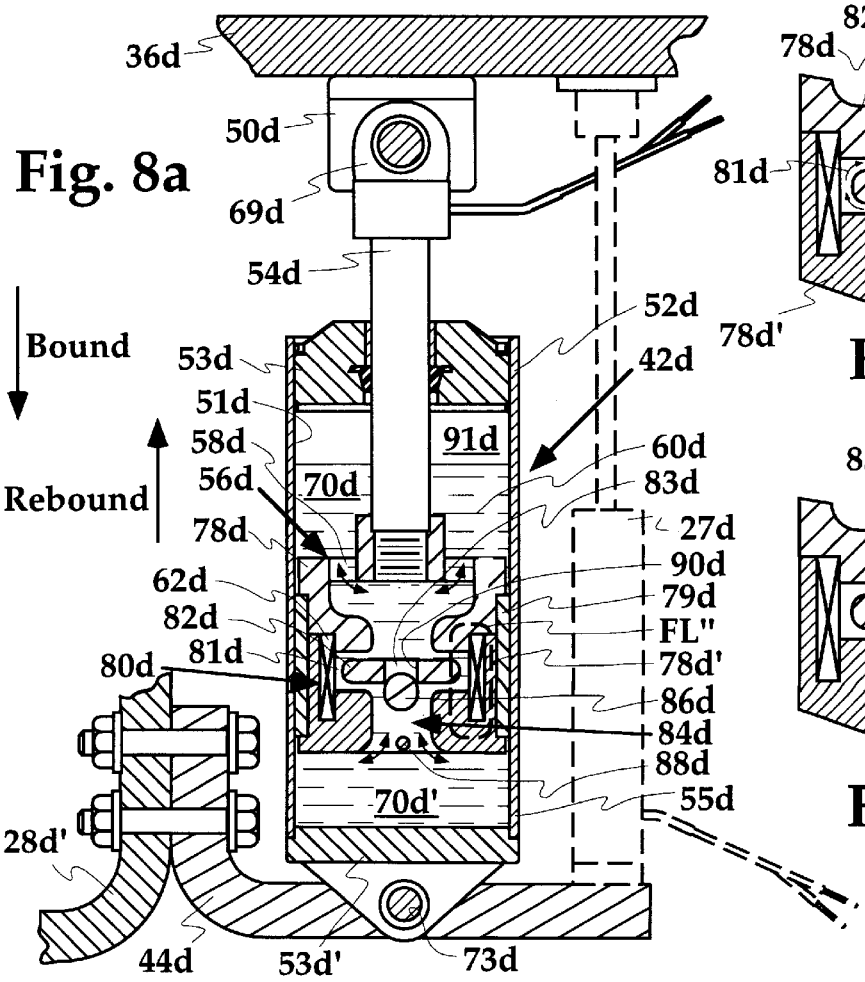
FIG. 8*a* illustrates a partial cross-sectional side view of the controllable assembly of FIG. 5, FIG. 8*b* and FIG. 8*c* illustrate partial cross-sectional side views of positions of a ball valve within the controllable assembly of FIG. 8*a* when the piston is moving in a first and second direction.

As shown in FIG. 8*a*, the damper 42*d* is a linear-acting magnetorheological fluid device and comprises a housing 52*d* which has a generally tubular body 55d which is closed at the ends by end caps 53*d*, 53*d*' thereby forming an internal cavity 51*d*. A piston 56*d* including a controllable valve 80*d* located therein is slidably received within the cavity 51*d* thereby partitioning the cavity 51*d* into a first fluid chamber 70*d* and second fluid chamber 70*d*'. A piston rod 54*d* is sealingly and slidably received in end cap 53*d* and is preferably rigidly secured to the piston 56*d*. A working MR fluid 60*d* is contained in the MR damper 42*d*. Appropriate means for attaching the MR damper 42*d* to the deck 36*d* and crossbars 28*d*', 28*d*" are employed, such as brackets 44*d*, 50*d*, rod end 69*d*, aperture 73*d*, and fasteners.

The piston 56*d* preferably includes a controllable valve assembly 80*d*, such as a magnetorheological valve, or the like, formed therein. A generally cylindrical wear band 79*d* of appropriate wear resistant material encircles the outer periphery of piston body and is preferably of suitable size to minimize egress of magnetorheological fluid 60*d* around the outside of piston 56*d* thereby forcing the majority of fluid 60*d* to flow through a fluid passageway 58*d* which interconnects between the first fluid chamber 70*d* with the second chamber 70*d*'.

The MR valve 80*d* is further comprised of a hoop (circumferentially) wound coil 62*d*, pole pieces 78*d*, 78*d*' for directing the magnetic flux, and baffle plate 82*d* which diverts fluid 60*d* so as to expose substantially more of it to the magnetic field. The user-controllable magnetic field controls flow of MR fluid 60*d* through a first portion (the bound path 81*d*) of the passageway 58*d*. The coil 62*d* creates a magnetic field within the controllable valve 80*d* to cause a change in rheology (an apparent viscosity change) of the MR fluid 60*d* in the bound path 81*d* portion of the passageway 58*d* which resultantly restricts the flow of fluid 60*d* through the bound path 81*d* of the valve 80*d* and causes a pressure buildup in the second (lower) chamber 70*d*' thereby requiring increased force to compress the damper 42*d*. This translates into a harder deck "feel", i.e., a higher restraining force in the "bound" direction. The pole pieces 78*d*, 78*d*' comprise the halves of the piston body and direct the magnetic flux toward the MR fluid 60*d* in the bound path 81*d*. A stationary baffle plate 82*d* located in the passageway 58*d* diverts the fluid flow perpendicular to the damper's axis and allows more of the fluid 60*d* in the passageway 58*d* to be exposed to the magnetic flux (denoted by FL") created within the magnetic circuit, thereby allowing higher restraining forces to be generated, as compared to straight-through valve configurations.

Figure 8B:
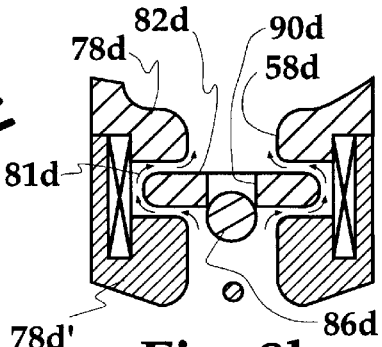
Figure 8C:
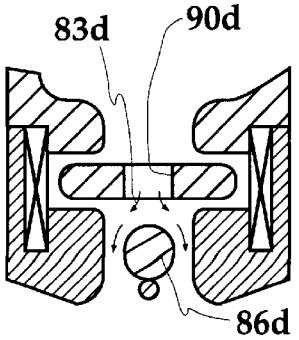

The valve 80*d* is preferably comprised of separate bound 81*d* and rebound paths 83*d*, thereby providing damping characteristics which are variable in the "bound" direction and uncontrollable or minimally controllable in the "rebound" direction. On the "bound" stroke, the fluid 60*d* passes through a first portion of the passageway 58*d* (the "bound" path 81*d*) as shown in FIG. 8*b*. This path 81*d* is exposed to the magnetic flux created by coil 62*d*. The level of damping of the dampers 42*d*, 42*d*' can be variably adjusted by the user (by adjusting the current supplied thereto) on the "bound" stroke to provide the appropriate "feel" to the deck 36*d*. Contrarily, on the "rebound" stroke, the MR fluid 60*d* passes through the "rebound" path 83*d* as is shown in FIG. 8*c* and is not exposed to any substantial magnetic field and, therefore, the flow of MR fluid 60*d* is substantially unrestricted and damping is substantially uncontrollable. Because a constant direct current is preferably applied to the valve 80*d*, on the "rebound" stroke, the fluid 60*d* is substantially stationary in the "bound" path 81*d* during rebound. The ball valve 84*d* which comprises a ball 86*d*, an orifice 90*d*, and a restraint member 88*d* is operable such that the ball 86*d* closes off the orifice 90*d* on the "bound" stroke, thereby forcing all MR fluid 60*d* to flow through the bound path 81*d*. On the "rebound" stroke, the ball valve 84*d* opens and substantially all flow of MR fluid 60*d* is through the lower resistance rebound path 83*d*. It is notable that the ball valve 84*d* is, therefore, a unidirectional valve (allows flow in one direction only) and is located at a position within the MR valve 80*d* where it is not subject to any substantial magnetic field. It should also be understood, that although this aspect of the invention has been described with reference to a controllable MR valve and damper, other controllable dampers may be used as well, such as controllable electro-mechanical dampers, Electrorheological (ER) dampers, Electrophoretic (EP) dampers, and the like. Optionally, if ball valve 84*d* were removed, including orifice 90*d* and ball 86*d*, the damper could be rapidly switched to accomplish the differential damping rates in the "bound" and "rebound" directions as has previously been described with reference to mounts. Sensor 27*d* would provide the appropriate deflection, velocity, and/or direction information in this instance. Notably, in a simple embodiment, no rapid switching or passive valve means would be incorporated. Only the current supplied to the plurality of dampers 42*d*, 42*d*' would be user-selectable.

Figure 9:
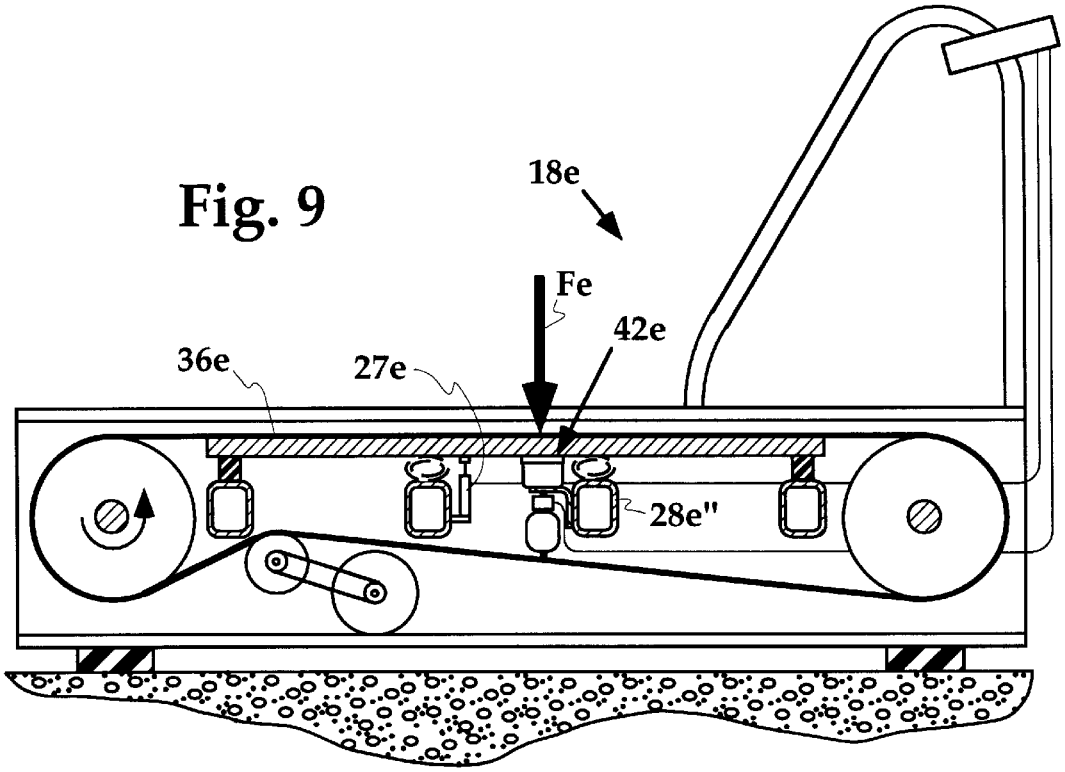
FIG. 9 illustrates a partial cross-sectioned side view of another controllable deck platform suspension system of the present invention on a treadmill illustrating application of another embodiment of MR mount.
Figure 10:
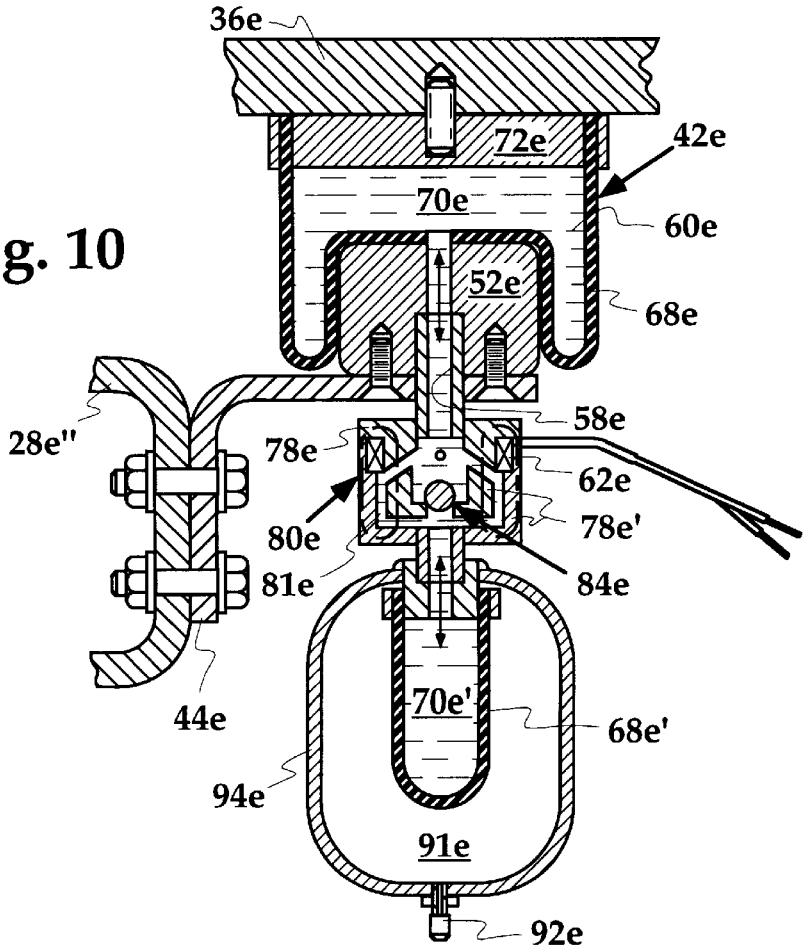
FIG. 10 illustrates a cross-sectional side view of the MR mount of FIG. 9.

Shown in FIG. 9 and FIG. 10 is another embodiment of MR mount 42*e* controlling the impact force characteristic of a deck 36*e* in a treadmill 18*e* which comprises a housing 52*e* interconnected to cross member 28*e*" by way of bracket 44*e* and appropriate fasteners, and an inner member 72*e* which attaches to deck 36*e* via appropriate fasteners, or other means. The mount 42*e* comprises a first fluid chamber 70*e* and a second fluid chamber 70*e*' interconnected by a fluid passageway 58*e*. Each of chambers 70*e*, 70*e*' comprise flexible members 68*e*, 68*e*' at least partially defining them. The top flexible member 68*e* preferably comprises a fabric-reinforced rolling diaphragm such that it exhibits a high bulge stiffness, yet provides minimal resistance to generally vertical motion. Contrarily, the lower flexible member 68*e*' preferably comprises a soft compliance, such as a stretchable rubber bladder. The lower chamber 70*e*' and flexible member 68*e*' are preferably substantially surrounded by a gas chamber 91*e* defined by rigid casing 94*e* which is gas filled via fill valve 92*e*. The gas chamber 91*e* is filled with air or other appropriate gas and provides an adjustable spring component to the MR mount 42*e*. The higher the pressure setting within chamber 91*e*, the stiffer the spring component is.

Within passageway 58*e* in fluid mount 42*e* is a controllable valve 80*e* which is preferably a MR valve and which comprises a coil 62*e* acting as a magnetic field generator for generating a magnetic field, pole pieces 78*e*, 78*e*' for directing the magnetic field applied to the MR fluid 60*e* contained in the bound path 81*e*, and a ball valve 84*e* for switching between the path portions as before-described with reference to the FIG. 8*a* damper. The valve 80*e* functions in substantially the same fashion as described with reference to FIG. 8*a*. Upon the impact force Fe being exerted on deck 36*e*, the MR fluid 60*e* flows through passageway 58*e* and into the bound passageway 81*e* and into lower chamber 70*e*'. By adjusting the current to coil 62*e*, flow through the bound path 81*e* is controlled, and thus the damping rate in bound. Substantially free flow in rebound is allowed via ball valve 84*e*. Although some parasitic damping may be present, this may be minimized through valve design. It should be appreciated that the two-way valves 80*e*, 80*d* (of FIG. 8*a*) described herein find equal applicability in dampers, mounts, and other controllable devices where controllability is desired in one direction while no controllability or substantially free flow is desired in the other. As in the previous embodiments, the ball valve 84*e* may be eliminated provided an appropriate sensor 27*e* is provided and a fast switching control algorithm is implemented. In this way, differential damping rates in bound and rebound may be achieved. Additionally, deflection-dependent impact characteristics in bound an/or rebound may be produced through appropriate feedback control.

Figure 11:
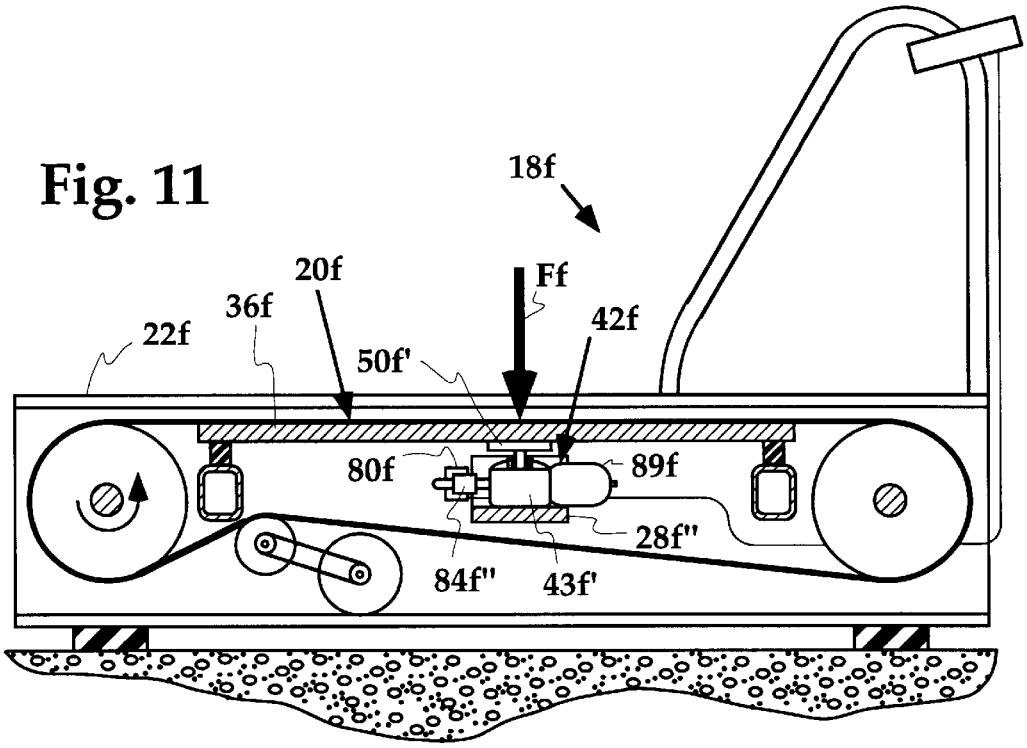
FIG. 11 illustrates a partial cross-sectioned side view of another controllable deck platform suspension system of the present invention on a treadmill with another embodiment of MR device.
Figure 12:
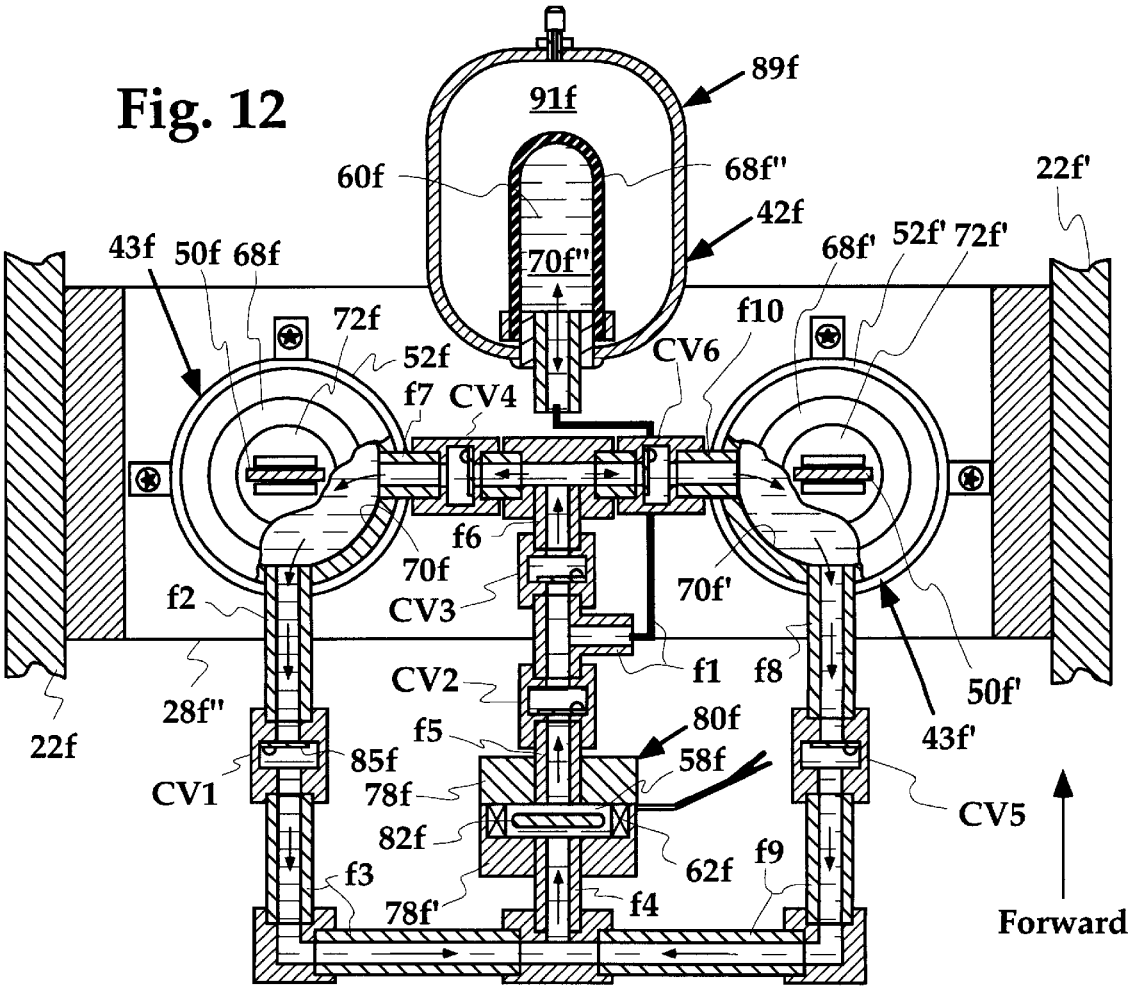
FIG. 12 illustrates a partial cross-sectional top view of the MR device of FIG. 11.

FIG. 11 and FIG. 12 describe another embodiment of MR mount 42*f* within a controllable platform support system 20*f* which is useful for supporting and controlling the impact damping conditions of platforms, such as decks or the like, such as in treadmill 18*f*. The MR mount 42*f* is preferably supported between a rigid crossbar 28*f*" which interconnects between the frame rails 22*f*, 22*f*' and the deck 36*f*. The mount 42*f* attaches to deck 36*f* by brackets 50*f*, 50*f*' on the left and right sides thereof. The MR mount 42*f* is preferably located at a forward position of deck 36*f* substantially adjacent to where the user will be contacting the deck 36*f* with his/her feet (near point of applied force Ff).

The MR mount 42*f* in this embodiment comprises first and second submounts 43*f*, 43*f*' which are interconnected to a series of channels f1–f10 and includes an accumulator 89*f*, a controllable valve 80*f*, and a series of check valves CV1–CV6 (some of which may not be needed). The accumulator 89*f* provides the spring component to the sealed fluid system. Pressurizing chamber 91*f* pressurizes the MR fluid 60*f* and compresses the accumulator's flexible member 68*f*" causing the MR fluid 60*f* in chamber 70*f*" to move through channel f1 and into the rest of the fluid system. This provides a pressure which acts against inner members 72*f*, 72*f*', housings 52*f*, 52*f*', and flexible members 68*f*, 68*f*' of submounts 43*f*, 43*f*', thereby causing inner members 72*f*, 72*f*' to rise up vertically relative to outer housings 52*f*, 52*f*'. The higher the pressure in chamber 91*f*, the higher the load that can be supported by the deck 36*f* and higher the spring rate experienced by the user.

The inner members 72*f*, 72*f*' interconnect to deck 36*f* via brackets 50*f*, 50*f*' such that when user exerts an impact force on the deck 36*f*, one or both of submounts 43*f*, 43*f*' will cause the MR fluid 60*f* to move through the various channels in a manner to be described. In particular, when a force is exerted directly adjacent to the first submount 43*f* (such as with the users left foot), the MR fluid 60*f* moves fluid out of chamber 70*f* and into channel f2 through check valve CV1 into channels f3 and f4, through controllable valve 80*f* and into channel f5, through check valve CV2 and into accumulator 89*f* through channel f1. Check valves CV3 and CV4 prevent flow of the MR fluid 60*f* through channels f6 and f7.

Likewise, when user's right foot impacts in the region of deck 36*f* adjacent second submount 43*f*', MR fluid 60*f* flows out of chamber 70*f*' into channel f8, through check valve CVS into channel f9, into channel f4, through controllable valve 80*f* and into channel f5, through check valve CV2 and into accumulator 89*f* through channel f1. Likewise, check valves CV3 and CV6 prevent flow in channels f6 and f10. The current supplied to coil 62*f* in valve 80*f* causes a magnetic field to be created in pole pieces 78*f*, 78*f*' which is directed toward, and causes a change in rheology in, the MR fluid 60*f* contained in the passageway 58*f*. Stationary baffle plate 82*f* causes the MR fluid 60*f* to be diverted laterally, such that more of the fluid 60*f* is subject to the magnetic field. The current supplied to coil 62*f* is user-adjustable, thereby allowing adjustment of the "feel" of the deck 36*f* by the user. High current applied restricts fluid motion, thereby providing a "hard" deck feel. Contrarily, low current applied provides a "soft" deck feel. This is substantially the same mount as was experimentally reduced to practice by the inventor. The only difference is that passive magnets of various strengths were used to control the deck feel and were attached adjacent to the position where the controllable valve 80*f* is now shown.

Figure 13:
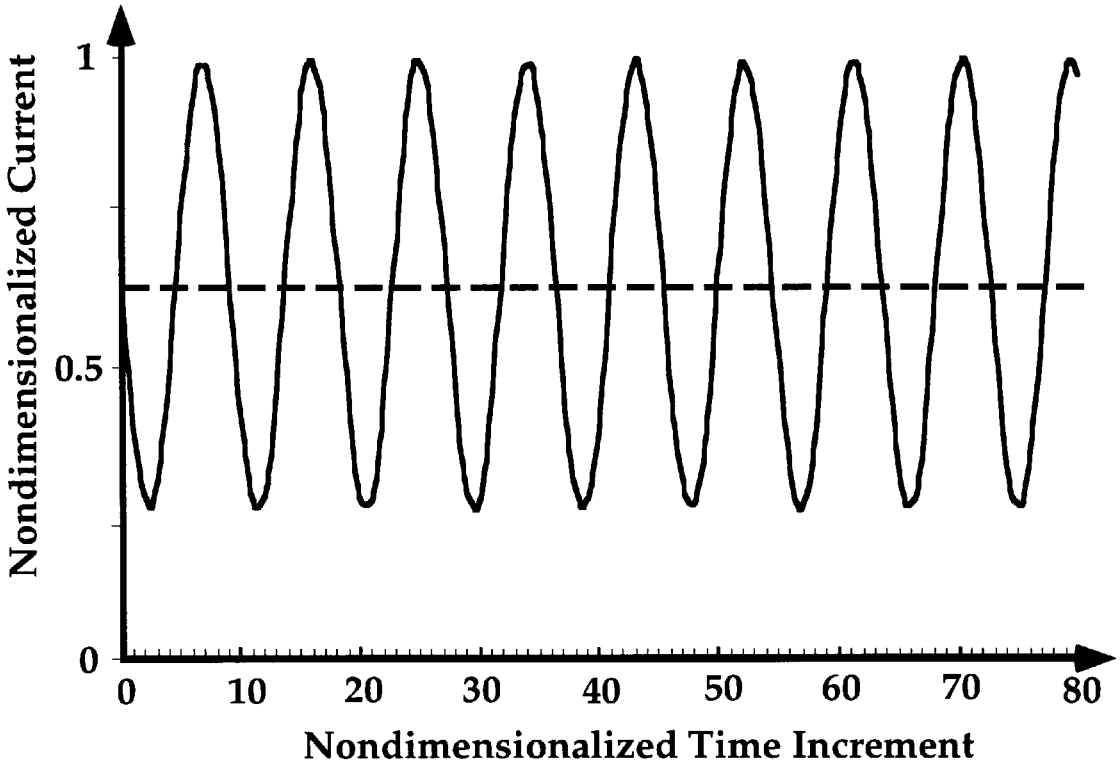
FIG. 13 illustrates one embodiment of a pulsed waveform which may be supplied to the MR device which has a sinusoidal shape.
Figure 14:
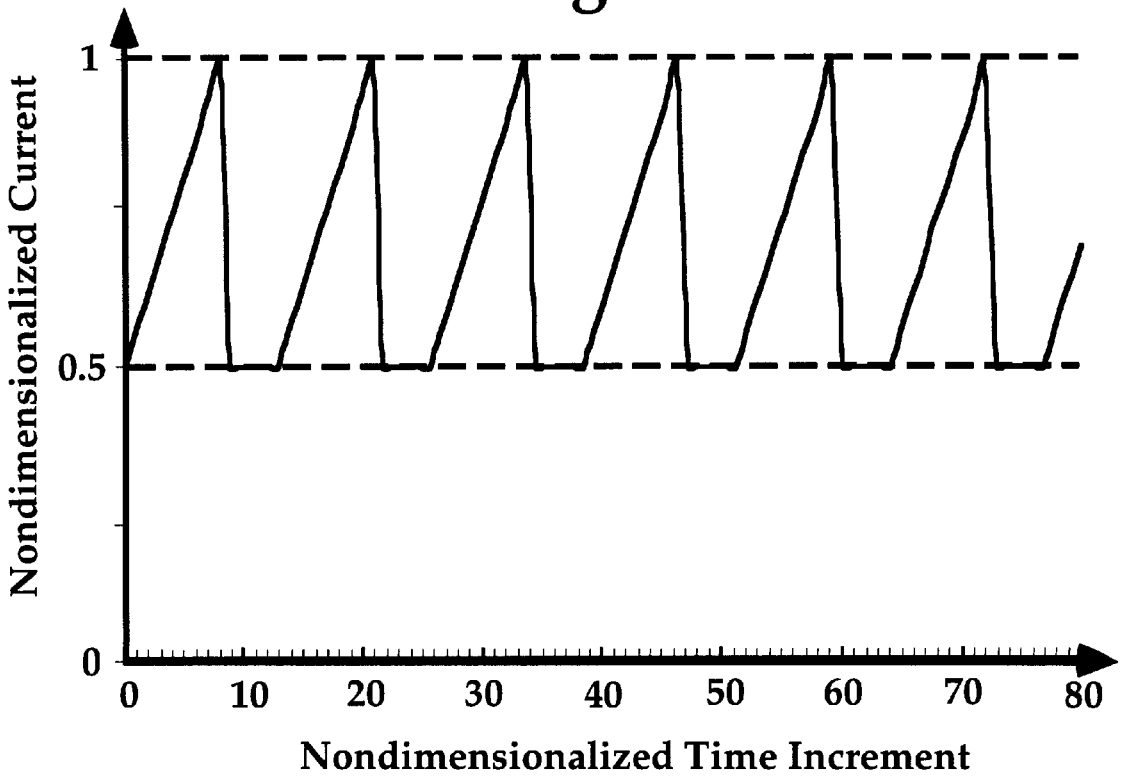
FIG. 14 illustrates another embodiment of a pulsed waveform which exhibits a ramp shape.
Figure 15:
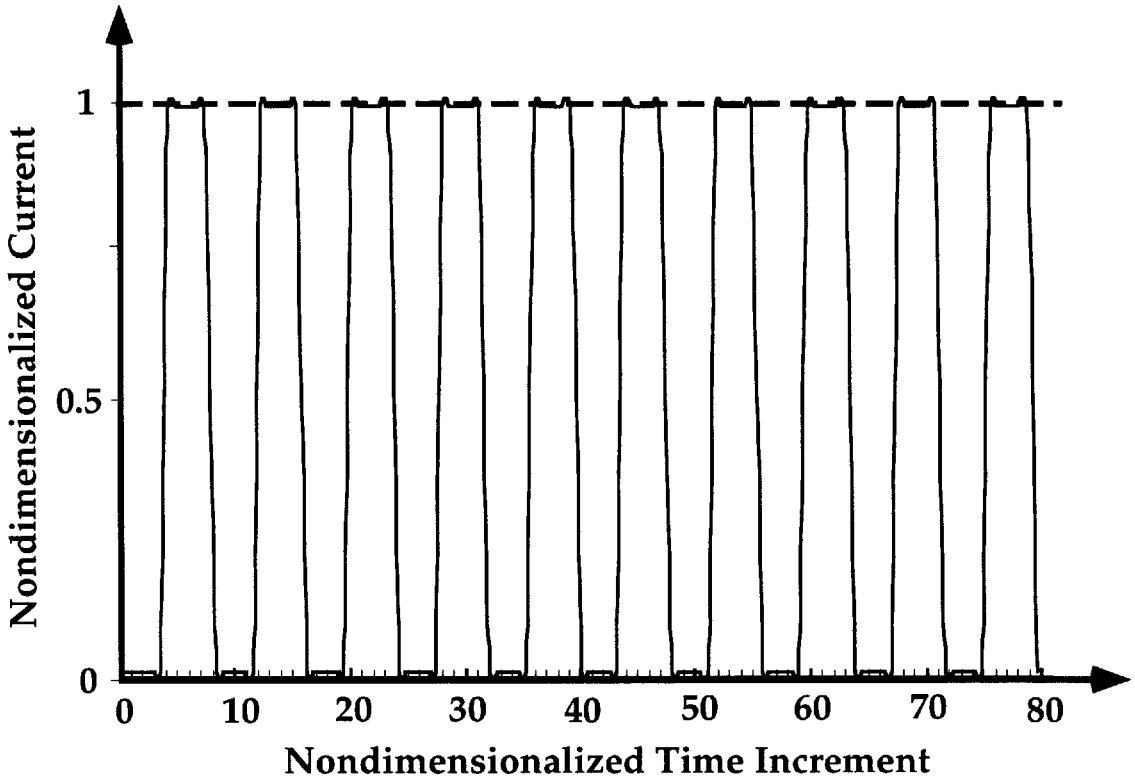
FIG. 15 illustrates another embodiment of a pulsed waveform which exhibits a square wave shape achieved via a pulse-width modulation technique.
Figure 16:
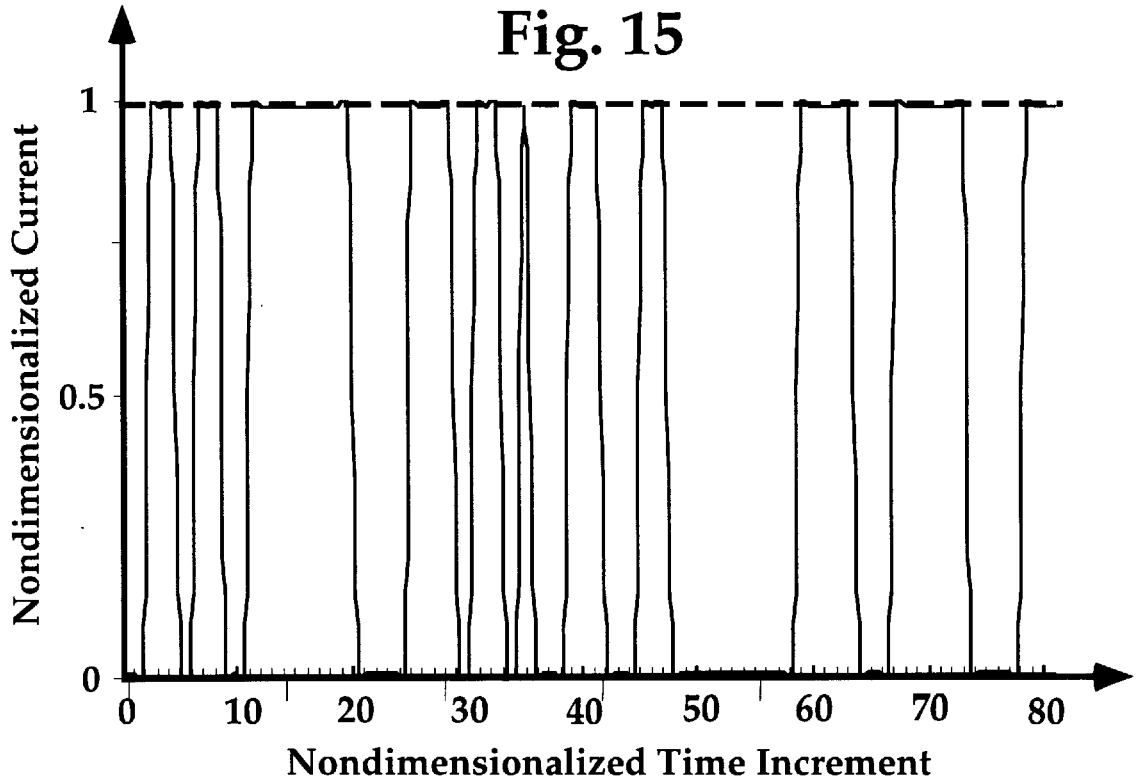
FIG. 16 illustrates another embodiment of a pulse-width modulated waveform whereby the pulse-width is randomly varied.
Figure 17:
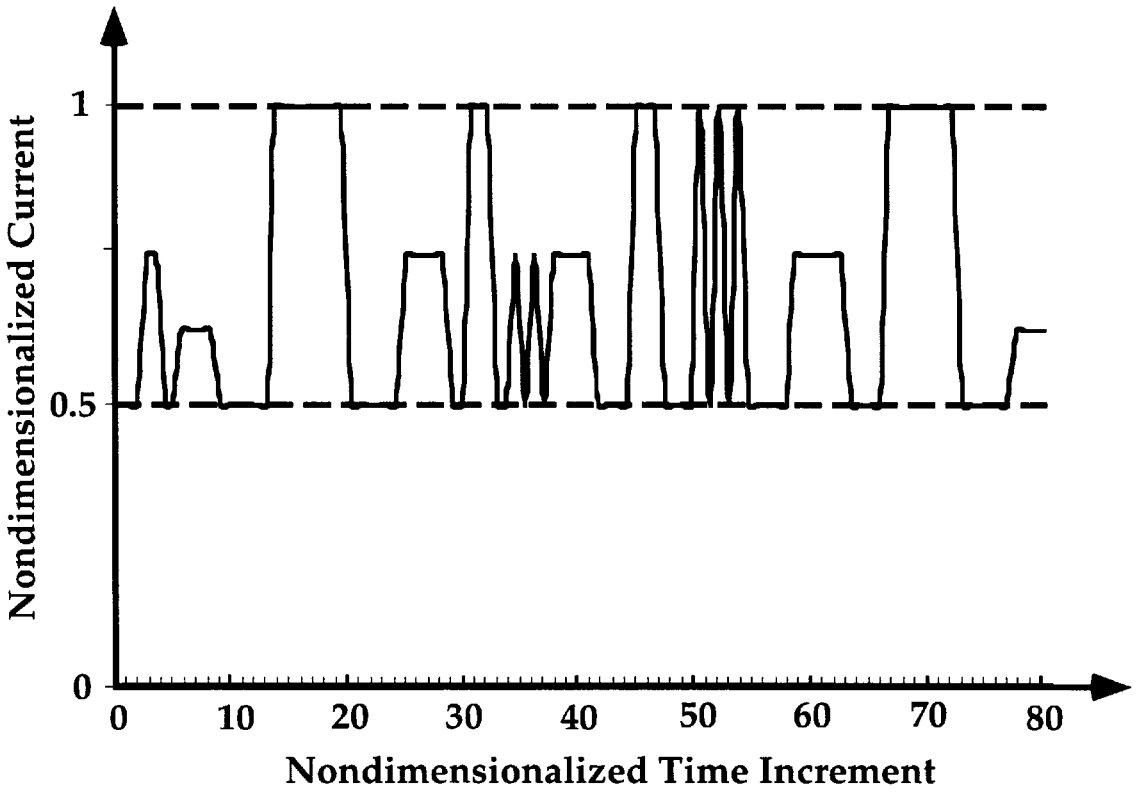
FIG. 17 illustrates another embodiment of a pulse-width modulated waveform whereby both the pulse-width and current magnitude are randomly varied.

FIG. 13 through FIG. 17 illustrate various pulse profiles (AC dithers) which can be applied to the MR devices described herein. In FIG. 13, a sinusoidal waveform is shown which varies from a minimum current to a maximum current, with some level of mean DC applied. This dither may be adjusted in amplitude and/or frequency as can the DC component. By inducing this dither, by way of an electrical oscillator or the like, a gravel or sand like surface "feel" of the deck may be achieved. Preferably, the frequency would be such that during one impact cycle, several full cycles of the pulsed waveform would be achieved. FIG. 14 shows a ramp waveform comprising a minimum current and a maximum current and whose slope, amplitude, and frequency interval may be adjusted. FIG. 15, 16 and 17 illustrate pulse-width-modulated waveforms. FIG. 15 illustrates a square waveform which is accomplished via pulse width modulating at a preferably user-selectable frequency between a maximum selectable current amplitude and zero current. FIG. 16 illustrates a pulse-width-modulated waveform which is accomplished via randomly generating the pulse width. FIG. 17 represents a waveform whereby the magnitude of the DC level is adjustable and the magnitude of the pulse width and magnitude of the amplitude of the oscillatory component are randomly generated. All of the abovementioned profiles which exhibit variable wave shapes, amplitudes, frequencies, or pulse widths of the applied current can be used to replicate or generate differing deck conditions and feel.

Figure 18:
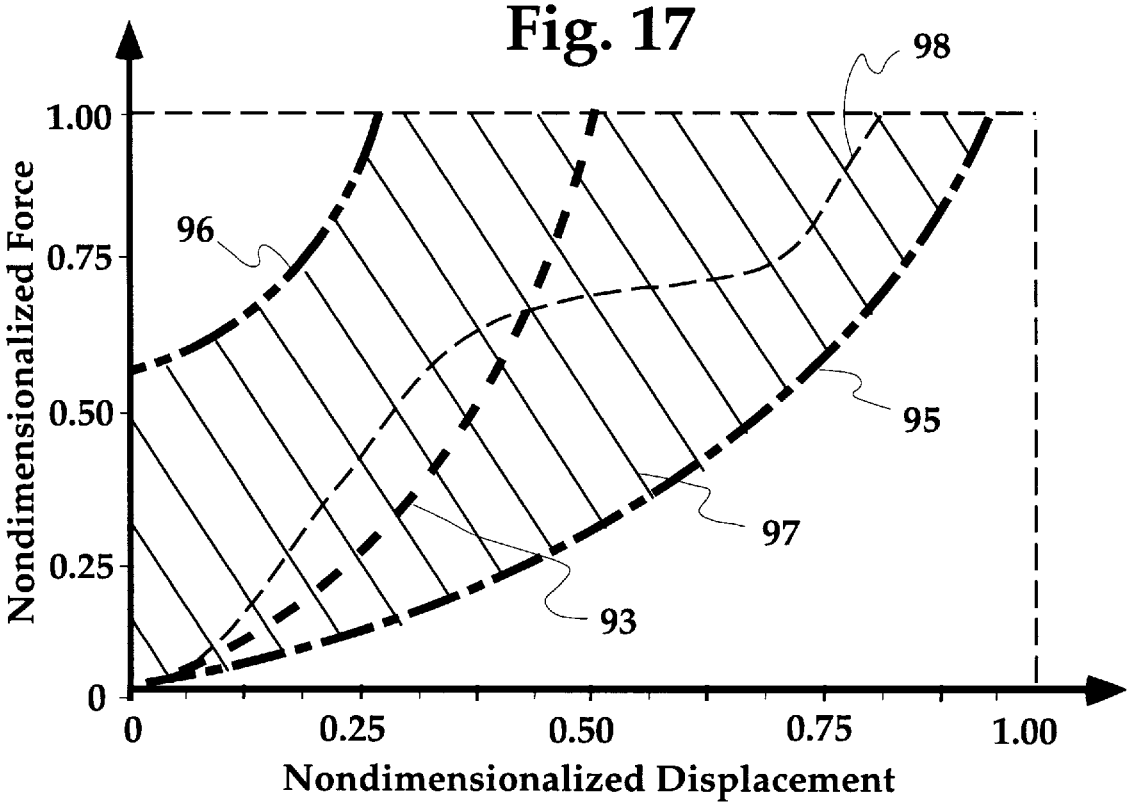
FIG. 18 illustrates various impact profiles of force v. deflection that may be achieved with the controllable deck suspension as compared to the baseline system.

FIG. 18 illustrates the deflection characteristics of the deck provided by the controllable deck suspension systems and controllable devices described herein. Curve 93 represents the baseline deck with flexible mounts and a flexible deck but no controllable suspension. Curve 95 and 96 illustrate estimates of the minimum and maximum portions of the stiffness envelope achievable upon implementing the controllable suspension system. Notably, the minimum stiffness curve 95 represents a system which is somewhat softer than the baseline system. The hatched portion 97 represents the area which is controllable. Any desired force v. deflection profile within these bounds is achievable. For example, a curve such as 98 may be produced through appropriate profile selection, whereby the user selects a profile and a lookup table sets the current as a function of displacement, direction, or other sensed parameter (such as velocity, acceleration or force) fed from a sensor located on the deck or between the deck and frame. It should be understood that any desirable force impact profile can be achieved within the bounds of the hatched portion 97.

Figure 19A:
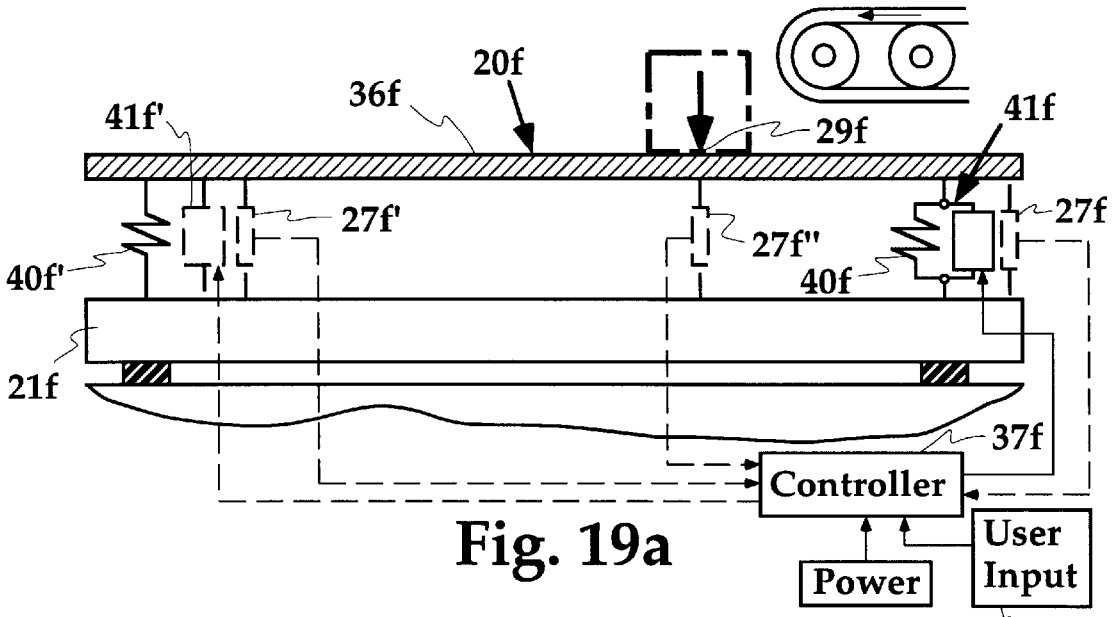
FIG. 19*a*–FIG. 19*k* illustrate various different controllable deck suspension configurations.

Various embodiments of controllable MR devices have been described herein, such as controllable MR brakes, controllable MR mounts, and controllable MR dampers. Further, specific attachment/location details have been described. Notably, with more generality, the invention herein and the location/attachment details are described with reference to FIGS. 19*a*–19*k* which show the platforms 36–36*h* which are flexibly suspended relative to frames 21*f*–*h*. In FIG. 19*a*, the flexible suspension may be provided by spring mounts, such as 40*f*, 40*f*' positioned near the ends of deck platform 36*f*. Preferably, one or more controllable assemblies 41*f*, 41*f*' are attached at at least one end, and preferably at two ends, of the deck 36*f* to control the impact characteristics thereof. The controllable assemblies 41*f* may comprise: a) the controllable device and an integrated spring 40*f*, or b) the spring 40*f*' may be separate from the controllable assembly 41*f*'. Optional sensors 27*f*, 27*f*' may provide displacement information or other parameters to the controller 37*f*. In a simple form, the impact characteristic of the deck 36*f* may be adjusted by a user input 87*f* (switch, dial, program). Alternatively, a central sensor 27*f*'' may be employed adjacent to the contact location 29*f*. The controllable impact condition deck platform assembly 20*f* is illustrated as a stand alone assembly. It should be understood that although the assembly finds key application to the treadmill, other applications of the invention described herein are possible, such as in a conveyor system, or in other impact absorbing applications where a moving element (user's leg, box, mechanical component) needs to be decelerated. This invention provides the means to preferably critically damp and decelerate any moving element that impacts the preferably substantially planar platform 36*f*.

Figure 19B:
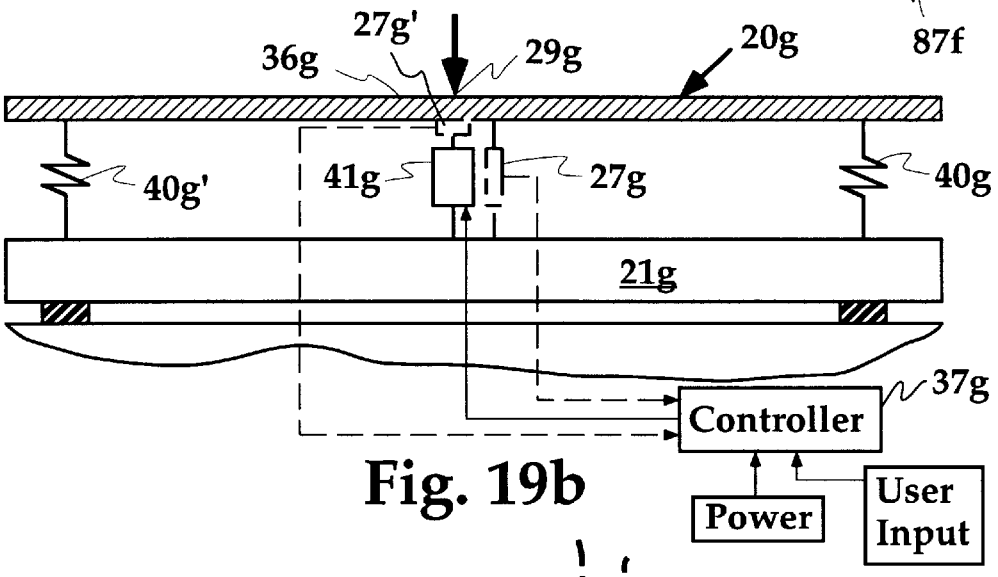

FIG. 19*b* illustrates another embodiment of controllable platform suspension system 20*g*, where passive springs 40*g*, 40*g*' are arranged at the ends of deck 36*g* and the controllable assembly 41*g* and optional sensor 27*g*, which is preferably a position sensor, is located at mid-deck or adjacent to the contact location 29*g*. Alternatively, a load cell 27*g*' may be implemented, preferably in series relationship, to the controllable assembly 41*g*, to provide direct force feedback. This enables sensing of the direct impact forces applied to decelerate the moving member which is abruptly contacting the deck 36*g*. The controller 37*g* may use this information, alone or together with, the deflection information obtained from the deflection sensor 27*g* to tailor the impact characteristics. This may allow "low impact" workouts for partially injured joggers, runners, etc. who may find it uncomfortable or medically unwise to jog or run without the "impact control." For example, the best footwear or a passively suspended deck may fall short and not sufficiently reduce the stress imparted to the user's legs.

Figure 19C:
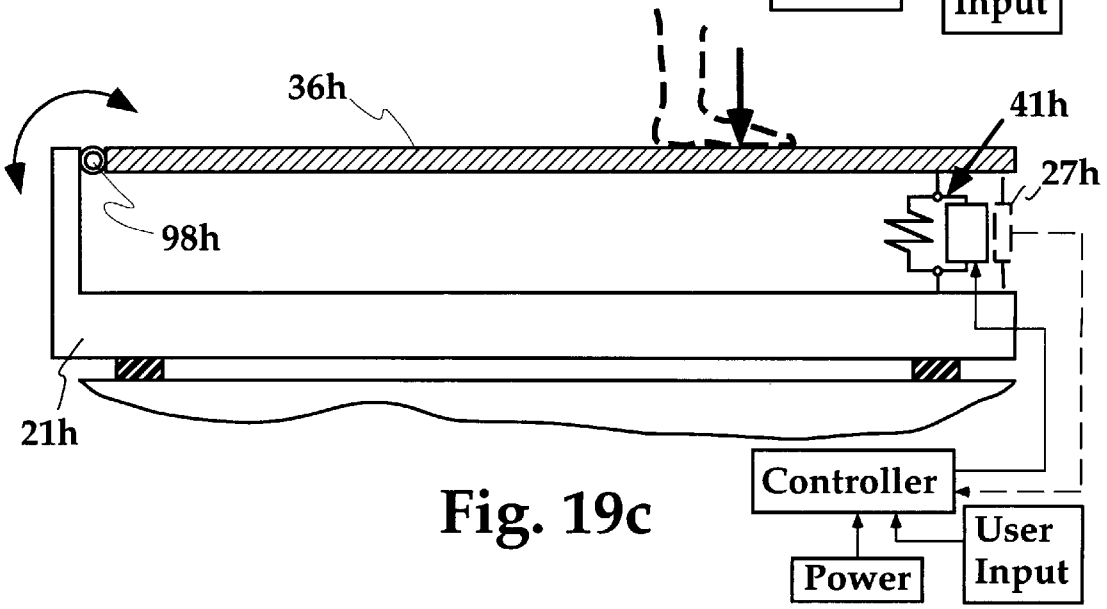
Figure 19D:
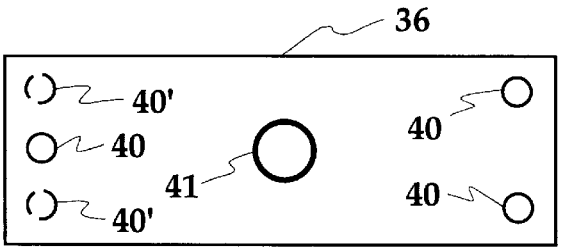
Figure 19E:
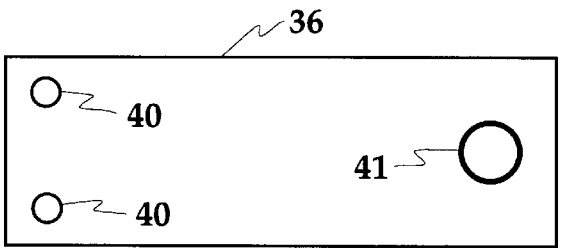

A pivoting embodiment is illustrated in FIG. 19*c*. The deck 36*h* pivots relative to frame 21*h* about pivot axis 98*h* at one end while the controllable assembly 41*h* and optional sensor 27*h* are located adjacent to the other. Pivoting the deck 36*h* minimizes the need for springs and controllable assemblies.

Figure 19F:
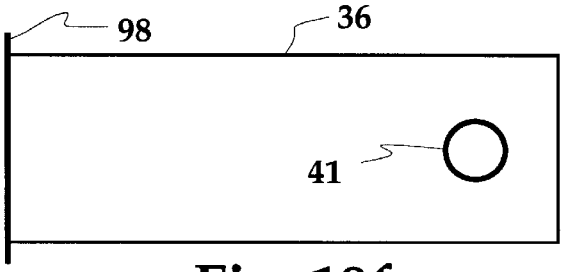
Figure 19G:
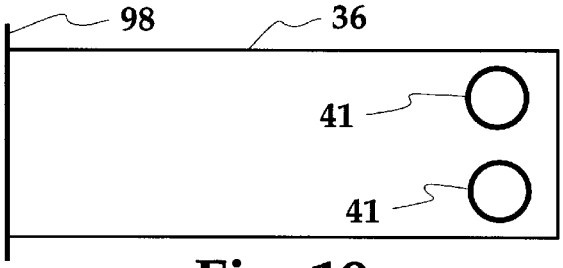

FIGS. 19*d*–19*k* illustrate schematic views of possible locations of the springs 40 and the controllable assemblies 41 (which may include an integral or collocated spring), where the small solid circles indicate spring locations and the large solid circles indicate controllable assemblies 41. Small dotted circles indicate alternate spring locations. For example, in FIG. 19*d* and FIG. 19*i*, springs 40 are positioned two at a first end and one at a second end of the deck 36 and one or more controllable assemblies 41 are placed adjacent to mid-deck. Optionally, the single spring at the second end may be replaced with two optional springs 40' and additional springs may be added intermediate the ends, as needed. This is comparable to the configuration shown in FIGS. 1, 3, and 10 described herein. FIG. 19*f* illustrates an embodiment with one controllable assembly 41 located at the first end of deck 36 and two springs 40 at the other. FIGS. 19*f* and FIG. 19*g* illustrate embodiments where the deck 36 pivots about pivot axis 98 and one or more controllable assemblies 41 are located adjacent to the first end of the deck 36. It is envisioned that twisting of the deck 36 would be desirable where two controllable assemblies 41 are employed, while when one is used, the deck 36 would preferably be substantially rigid.

Figure 7:
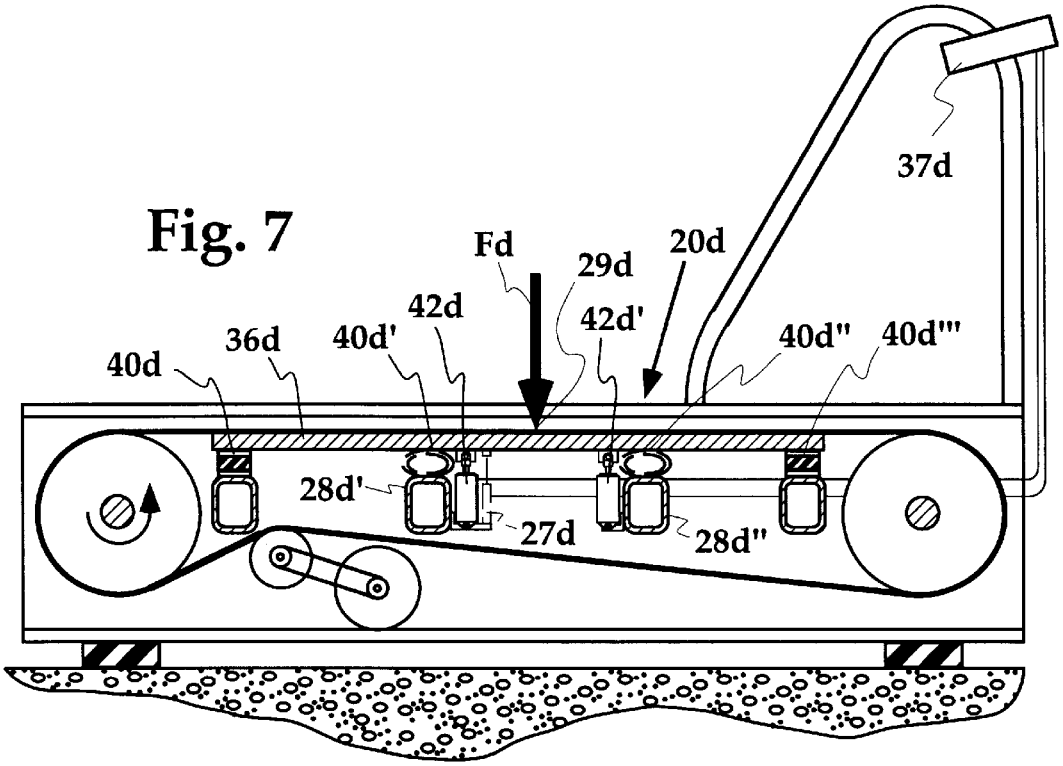
FIG. 7 illustrates a partial cross-sectioned side view of another controllable deck platform suspension system of the present invention on a treadmill with a plurality of linear MR dampers providing controllability.
Figure 19H:
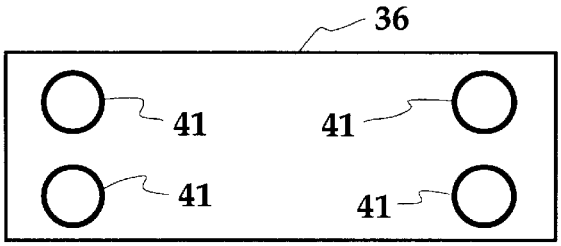
Figure 19I:
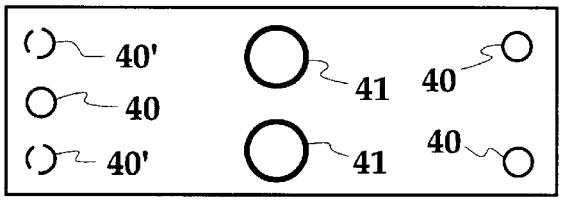
Figure 19J:
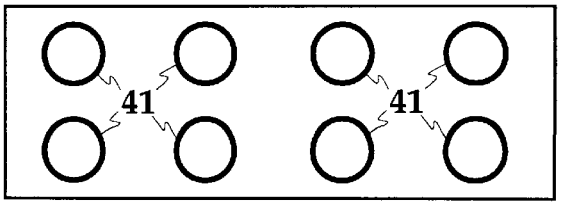
Figure 19K:
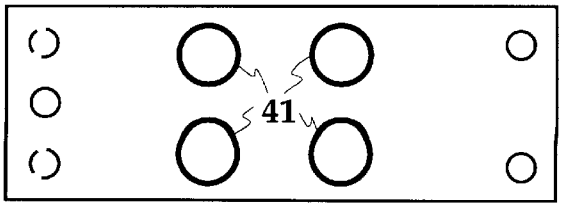

FIG. 19*h* illustrates an embodiment with controllable assemblies 41 located at all four corners of the deck 36. Additional springs may be provided intermediate the ends as needed (not shown). FIG. 19*j* illustrates an embodiment with a plurality of controllable assemblies 41 similar to that described with reference to FIG. 5. FIG. 19*k* illustrates a plurality of controllable assemblies 41 attached adjacent mid-deck as shown in FIG. 7. It should be recognized that other installation configurations would fall under the scope of the appended claims.

Generally, it should be understood that, although, the preferred embodiment of controllable assembly includes an electromechanical controllable MR device, other electromechanical controllable devices may perform acceptably, as well. It is contemplated that all such controllable assemblies would fall within the scope of the appended claims. For example, Electrorheological (ER) dampers or mounts, Electrophoretic (EP) brakes or dampers, controllable electromechanical (Semi-active) dampers, or controllable mounts, may be employed. It should be recognized that the controllable deck platform system including any of the controllable assemblies afore-mentioned may be used for controlling the "impact condition" of the deck. For example, in a treadmill, a user variable "feel" may be derived. In a conveyor system, a semi-fragile element (box, mechanical component, etc.) may be protected from impact as it strikes the deck platform upon exiting from a conveyor.

In summary, the present invention is a controllable platform suspension system for absorbing impacts to moving member, comprising a frame, a platform, a plurality of springs for flexibly suspending said platform relative to said frame, and at least one electro-mechanical controllable assembly interconnected between said frame and said platform for providing a user controllable impact characteristic.

While several embodiments including the preferred embodiment of the present invention have been described in detail, various modifications, alterations, changes, and adaptations to the aforementioned may be made without departing from the spirit and scope of the present invention defined in the appended claims. It is intended that all such modifications, alterations, and changes be considered part of the present invention.

We claim:

1. A controllable platform suspension system for absorbing impacts imparted to a moving member, comprising:

(a) a platform mountable for movement in a substantially vertical, downward, bound direction and in a rebound direction;

(b) at least one controllable electromechanical assembly interconnected to said platform for providing user-controllable impact characteristics including a bound direction damping rate, said electromechanical assembly operable to provide a plurality of different said bound direction damping rates; and (c) a controller for controlling said electromechanical assembly in response to user input to provide a selected one of said plurality of different said bound direction damping rates.

2. A system of claim 1, further comprising:

(a) a frame, (c) spring means for flexibly suspending said platform relative to said frame.

3. A system of claim 2 wherein said at least one controllable electro-mechanical assembly includes a controllable fluid device interconnected between said frame and said platform.

4. A system of claim 3 wherein said controllable fluid device includes a controllable fluid damping valve controlling flow of a magnetorheological fluid therethrough and having a magnetic field generator producing a magnetic field contained therein, said valve means further comprising;

(i) a first path portion exposed to said magnetic field whose flow is controllable for controlling a bound damping condition of said platform, and (ii) a second path portion not contained within said magnetic field for allowing a substantially unrestrained rebound condition thereby allowing different bound and rebound rates without having to rapidly switch a current applied to said controllable fluid damping valve.

5. A system of claim 2 wherein said at least one controllable electro-mechanical assembly includes a controllable fluid device further comprising:

(a) a first fluid chamber, (b) a second fluid chamber, (c) a fluid passageway interconnecting said first and second fluid chambers, (d) a controllable fluid within said first and second fluid chambers and said fluid passageway, (e) said first fluid chamber including a first flexible member, (f) said second fluid chamber including a second flexible member, (g) a charge chamber surrounding said second flexible bladder and pressurizing same, and (h) a controllable fluid damping valve having magnetic flux generating means for generating a magnetic flux, and a magnetic circuit for directing said magnetic flux toward said fluid passageway to provide controllable damping forces.

6. A system of claim 1 wherein said at least one controllable electro-mechanical assembly is attached between a frame and a treadmill deck of a treadmill and provides user-controllable impact characteristics for said treadmill deck.

7. A system of claim 1 further comprising:

(a) a treadmill frame, (b) said platform is a treadmill deck, (c) means for allowing movement of said treadmill deck in said substantially vertical, downward, bound direction and in said rebound direction relative to said treadmill frame, and (d) said controllable electro-mechanical assembly for controlling an impact condition of said treadmill deck.

8. A system of claim 7 wherein said electro-mechanical assembly comprises a controllable device selected from a group consisting of:

(a) a magnetorheological fluid device, (b) a electrorheological fluid device, (c) a electrophoretic fluid device, (d) a semi-active electromechanical device, and (e) a controllable mounting.

9. A treadmill deck suspension system of claim 7 wherein said controllable device is a linear-acting magnetorheological fluid damper.

10. A treadmill deck suspension system of claim 9 wherein said linear-acting magnetorheological fluid damper further comprises:

(a) a housing having an internal cavity, (b) means for interconnecting said housing to said treadmill frame, (c) a piston rod slidably and sealingly received in said housing, (d) means for interconnecting said piston rod to said treadmill deck, (e) a piston attached to said piston rod and slidably received within said housing thereby partitioning said internal cavity into a first chamber and a second chamber, (f) a fluid passageway interconnecting said first chamber to said second chamber, (g) a magnetorheological fluid contained within said first chamber, said second chamber, and said fluid passageway, and (h) a magnetorheological valve interacting with said fluid passageway which when electrically energized generates a magnetic field thereby causing a change in rheology of said magnetorheological fluid and restricting flow of said magnetorheological fluid through said fluid passageway thereby controlling a damping force exerted between said treadmill deck and said treadmill frame.

11. A treadmill deck suspension system of claim 10 wherein said magnetorheological valve comprises a check valve operative therewith such that flow of said magnetorheological fluid is through a first path portion of said fluid passageway which is exposed to said magnetic field during said bound condition thereby providing user controllability in bound and flow is through a second path portion which is exposed to substantially less of said magnetic field during a rebound condition thereby providing a minimal restriction.

12. A treadmill deck suspension system of claim 7 wherein said magnetorheological fluid device is a magnetorheological fluid mounting.

13. A treadmill deck suspension system claim 12 wherein said mounting comprises:

(a) at least one flexible member, (b) a first fluid chamber at least partially defined by said at least one flexible member, (c) a magnetorheological fluid contained within said first fluid chamber, (d) controllable means for restricting flow of said magnetorheological fluid either;

(i) within said first fluid chamber, or (ii) exiting from said first fluid chamber.

14. A treadmill deck suspension system of claim 13 wherein said controllable means for restricting flow of said magnetorheological fluid is comprised of a magnetorheological fluid valve.

15. A treadmill deck suspension system of claim 14 wherein said magnetorheological fluid valve includes a fluid passageway therein having a bound path portion and a separate rebound path portion.

16. A treadmill deck suspension system of claim 15 wherein said bound path portion is exposed to a magnetic field and said separate rebound path portion is not.

17. A treadmill deck suspension system of claim 15 further including a second fluid chamber interconnected to said first fluid chamber by said fluid passageway.

18. A treadmill deck suspension system of claim 17 wherein said second fluid chamber comprises a flexible bladder which is interactive with a gas charged chamber.

19. A treadmill deck suspension system of claim 13 wherein said controllable mounting is comprised of:

(a) a wound coil, (b) a first pole piece, and (c) a return path, whereby when said controllable means is electrically energized it operates in a squeeze film mode restricting flow of said magnetorheological fluid within said first fluid chamber.

20. A controllable platform suspension system comprising:

(a) a treadmill deck;

(b) a treadmill frame;

(c) means for allowing movement of said treadmill deck relative to said treadmill frame;

(b) at least one controllable electromechanical assembly interconnected to said treadmill deck for providing user-controllable impact characteristics including an impact condition of said treadmill deck, wherein said controllable electro-mechanical assembly includes a rotary-acting magnetorheological fluid device.

21. A system of claim 20 wherein said rotary-acting magnetorheological fluid device is comprised of:

(a) a housing having a recess formed therein, (b) means interconnecting said housing to said treadmill frame, (c) a shaft supported by, yet free to rotate relative to, said housing, (d) means interconnecting said shaft to said treadmill deck, (e) a rotor rotatably secured to said shaft and received within said recess thereby forming at least one gap, (f) a magnetorheological fluid contained within said at least one gap, (g) magnetic field producing means for producing a magnetic flux when electrically energized, and (h) a magnetic circuit for directing said magnetic flux toward said magnetorheological fluid contained within said at least one gap causing an apparent viscosity change of said magnetorheological fluid thereby increasing a vertical restraining force exerted between said treadmill frame and said treadmill deck.

22. A system of claim 21 wherein said rotary-acting magnetorheological device includes a one-way clutch attached thereto, said one-way clutch being engaged upon generally vertical movement of said treadmill deck thereby driving said rotary-acting magnetorheological fluid device in one direction of rotation only.

23. A system of claim 22 wherein a linkage and lever interconnect between said treadmill deck and said one-way clutch thereby converting said generally vertical motion into rotary motion of said one-way clutch.

24. A system of claim 21 wherein a rack-and-pinion assembly interconnects between said treadmill deck and said shaft and converts vertical motion of said treadmill deck into rotary motion of said shaft.

25. A system of claim 7 wherein said electro-mechanical assembly is further comprised of a magnetorheological fluid device for which an amplitude of a current waveform supplied thereto is pulsed.

26. A system of claim 25 wherein a pulse width or an amplitude of said current waveform is user adjustable.

27. A system of claim 25 wherein an individual pulse of said current waveform has a (a) a sinusoidal shape, (b) a triangular shape, or (c) a square wave shape.

28. A system of claim 25 wherein a pulse width of said current waveform is modulated from a minimum to a maximum current and a predetermined frequency.

29. A treadmill deck suspension system including the controllable platform suspension system of claim 1 wherein said at least one electromechanical assembly includes:

(a) a first fluid chamber, (b) a second fluid chamber, (c) a fluid passageway interconnecting said first and second fluid chambers, (d) a controllable fluid within said first and second fluid chambers and said fluid passageway, (e) said first fluid chamber including a flexible member, (f) said second fluid chamber including a flexible member, (g) a charge chamber surrounding said flexible member and pressurizing same, and (h) a controllable fluid damping valve having magnetic flux generating means for generating a magnetic flux, and a magnetic circuit for directing said magnetic flux toward said fluid passageway to provide controllable damping forces.

30. A treadmill deck suspension system claim 29 further comprising:

(a) a first path portion within said fluid passageway which is exposed to said magnetic field and whose flow is controllable for controlling a damping condition in a first flow direction, and (b) a second path portion for allowing substantially unrestrained flow in a second flow direction.

31. A controllable platform suspension system for absorbing impacts imparted to a moving member, comprising:

(a) a platform;

(b) a frame;

(c) spring means for flexibly suspending said platform relative to said frame such that said platform is movable in a substantially vertical, downward, bound direction and in a rebound direction relative to said frame;

(d) at least one controllable fluid device interconnected to said platform for providing user-controllable impact characteristics including a bound direction damping rate, said controllable fluid device operable to provide a plurality of different said bound direction damping rates; and (e) a controller for controlling said controllable fluid device in response to user input to provide a selected one of said plurality of different said bound direction damping rates.

32. A system of claim 1 wherein said electromechanical assembly provides a rebound direction damping rate to said platform, said rebound direction damping rate being less than each of said plurality of bound direction damping rates.

33. A system of claim 32 wherein said rebound direction damping rate is substantially zero.

34. A controllable platform suspension system for absorbing impacts imparted to a moving member, comprising:

a platform;

a frame, at least one controllable electro-mechanical assembly interconnected to said platform for providing user-controllable impact characteristics, wherein said controllable electromechanical assembly includes a rotary-acting magnetorheological fluid device, said fluid device further comprising:

(a) a housing having a recess formed therein, (b) means interconnecting said housing to said frame, (c) a shaft supported by, yet free to rotate relative to, said housing, (d) means interconnecting said shaft to said platform, (e) a rotor rotatably secured to said shaft and received within said recess thereby forming at least one gap, (f) a magnetorheological fluid contained within said at least one gap, (g) magnetic field producing means for producing a magnetic flux when electrically energized, and (h) a magnetic circuit for directing said magnetic flux toward said magnetorheological fluid contained within said at least one gap causing an apparent viscosity change of said magnetorheological fluid thereby increasing a vertical restraining force exerted between said frame and said platform.

35. A system of claim 34 wherein said rotary-acting magnetorheological device includes a one-way clutch attached thereto, said one-way clutch being engaged upon generally vertical movement of said platform thereby driving said rotary-acting magnetorheological fluid device in one direction of rotation only.

36. A system of claim 35 wherein a linkage and lever interconnect between said platform and said one-way clutch thereby converting said generally vertical motion into rotary motion of said one-way clutch.

37. A system of claim 34 wherein a rack-and-pinion assembly interconnects between said platform and said shaft and converts vertical motion of said platform into rotary motion of said shaft.

* * * * *